US007239285B2

(12) United States Patent
Cook

(10) Patent No.: US 7,239,285 B2
(45) Date of Patent: Jul. 3, 2007

(54) CIRCULAR POLARITY ELLIPTICAL HORN ANTENNA

(75) Inventor: Scott J. Cook, Garner, NC (US)

(73) Assignee: ProBrand International, Inc., Marietta, GA (US)

( * ) Notice: Subject to any disclaimer, the term of this patent is extended or adjusted under 35 U.S.C. 154(b) by 202 days.

(21) Appl. No.: 11/132,763

(22) Filed: May 18, 2005

(65) Prior Publication Data

US 2005/0259026 A1 Nov. 24, 2005

Related U.S. Application Data

(60) Provisional application No. 60/572,080, filed on May 18, 2004, provisional application No. 60/571,988, filed on May 18, 2004.

(51) Int. Cl.
*H01Q 13/00* (2006.01)

(52) U.S. Cl. ..... 343/786; 343/772; 333/21 A; 333/21 R

(58) Field of Classification Search ..... 343/786, 343/772; 333/21 A, 21 R
See application file for complete search history.

(56) References Cited

U.S. PATENT DOCUMENTS 3,024,463 A * 3/1962 Moeller et al. ..... 343/783
4,356,495 A * 10/1982 Morz ..... 343/786
4,673,905 A * 6/1987 Yamawaki et al. ..... 333/239
5,438,340 A * 8/1995 Fukuzawa et al. ..... 343/781 R
5,614,916 A 3/1997 Mizuguchi
6,992,639 B1 * 1/2006 Lier ..... 343/786
2004/0021614 A1 2/2004 Moheb

FOREIGN PATENT DOCUMENTS

WO WO 01/67555 A2 9/2001

* cited by examiner

*Primary Examiner*—Hoang V. Nguyen
(74) *Attorney, Agent, or Firm*—Michael J. Mehrman; Mehrman Law Office, PC

(57) ABSTRACT

A relatively low cost, easy to install and aesthetically pleasing digital video broadcast from satellite (DVBS) elliptical horn antenna designed as part of a reflector antenna system to receive satellite television broadcast signals with circular polarity. This type antenna may be implemented with a single antenna feed horn with multiple feed horns that may be arranged separately or in one or more integral feed horn blocks. The antennas may be designed to achieve acceptable circular polarity performance over broad and multiple frequency bands through the use of oppositely sloped differential phase differential sections.

19 Claims, 23 Drawing Sheets

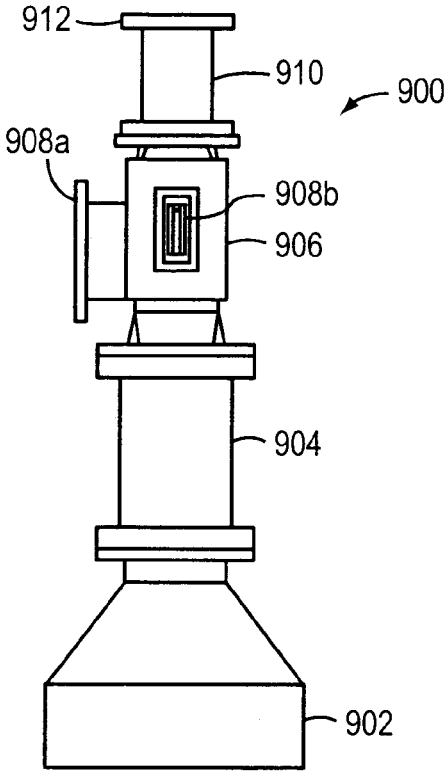
FIG. 9A.1
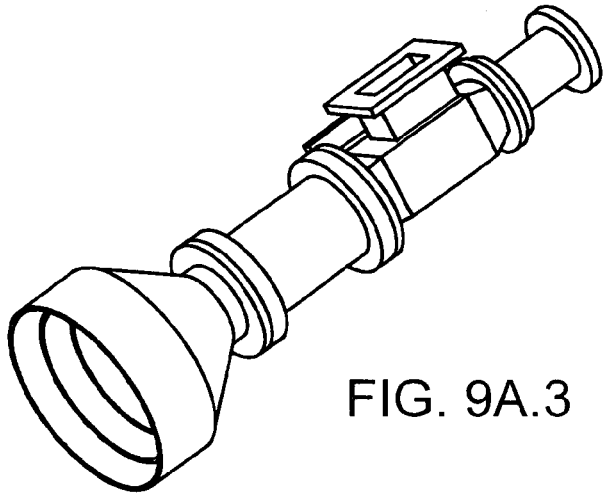
FIG. 9A.3
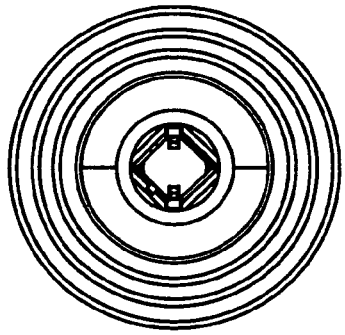
FIG. 9A.4
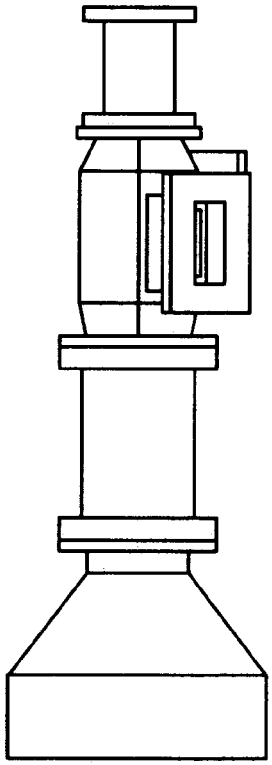
FIG. 9A.2
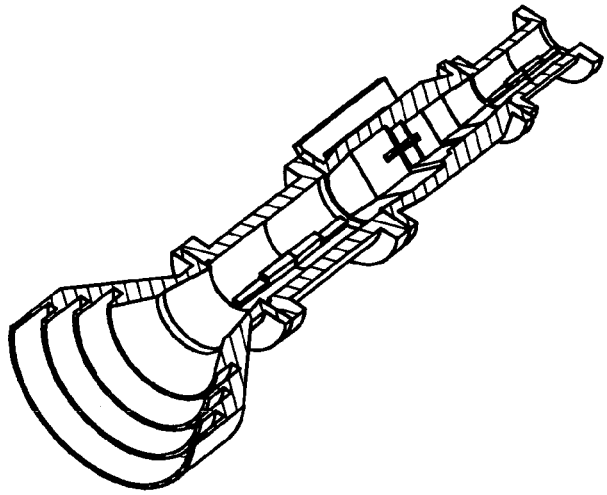
FIG. 9A.5

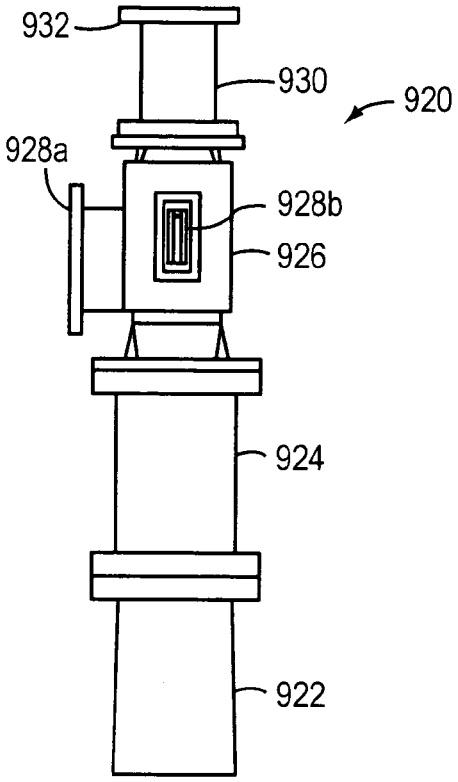
FIG. 9B.1
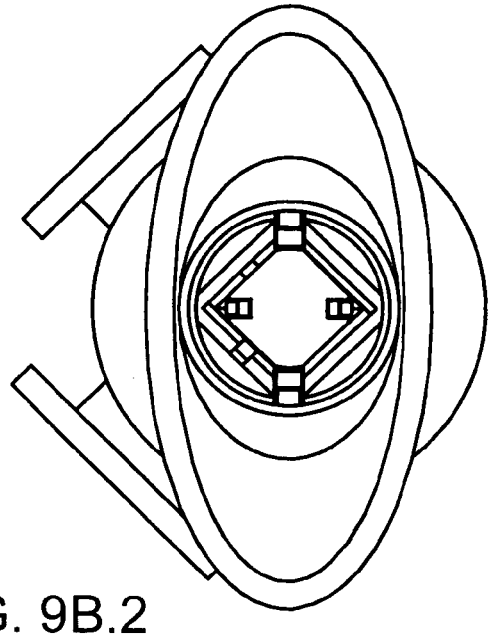
FIG. 9B.2
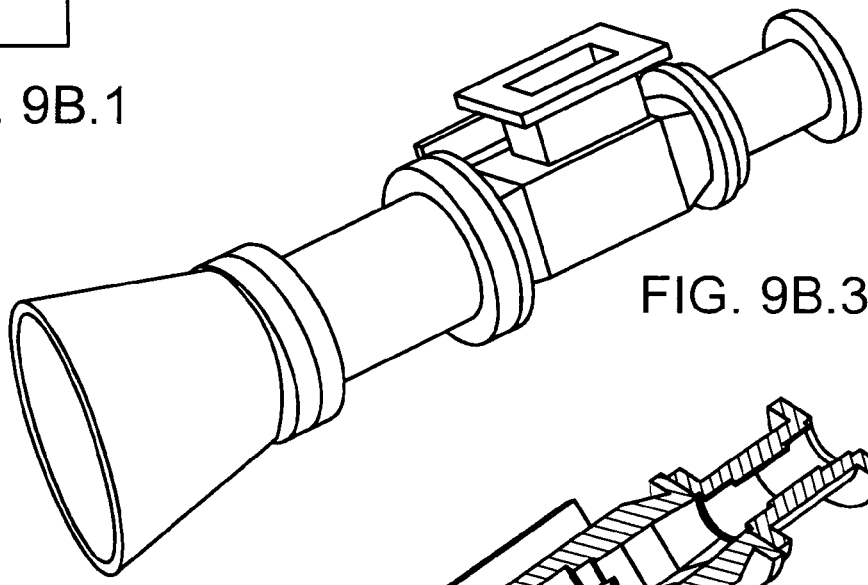
FIG. 9B.3
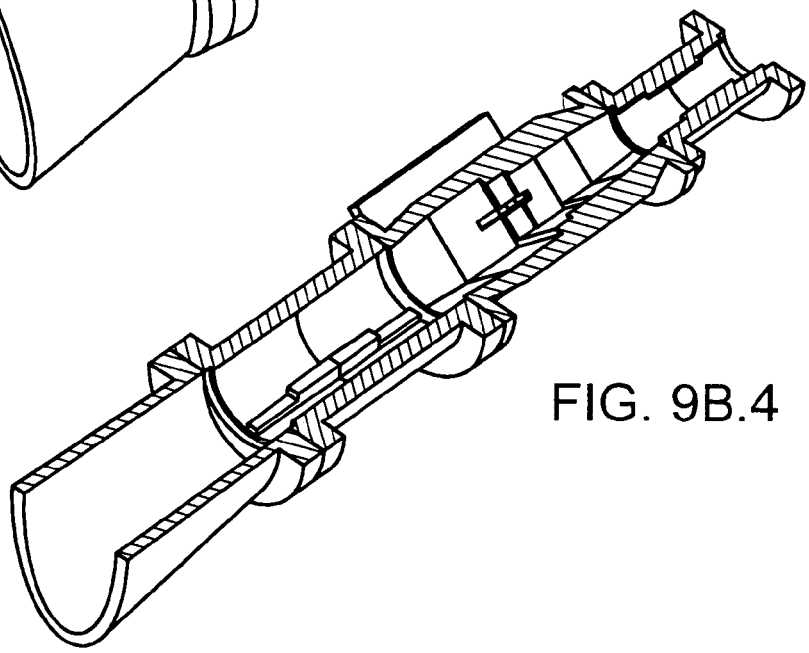
FIG. 9B.4

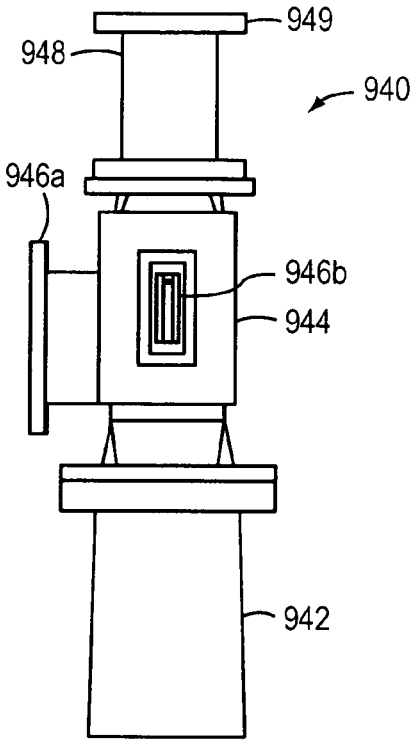
FIG. 9C.1
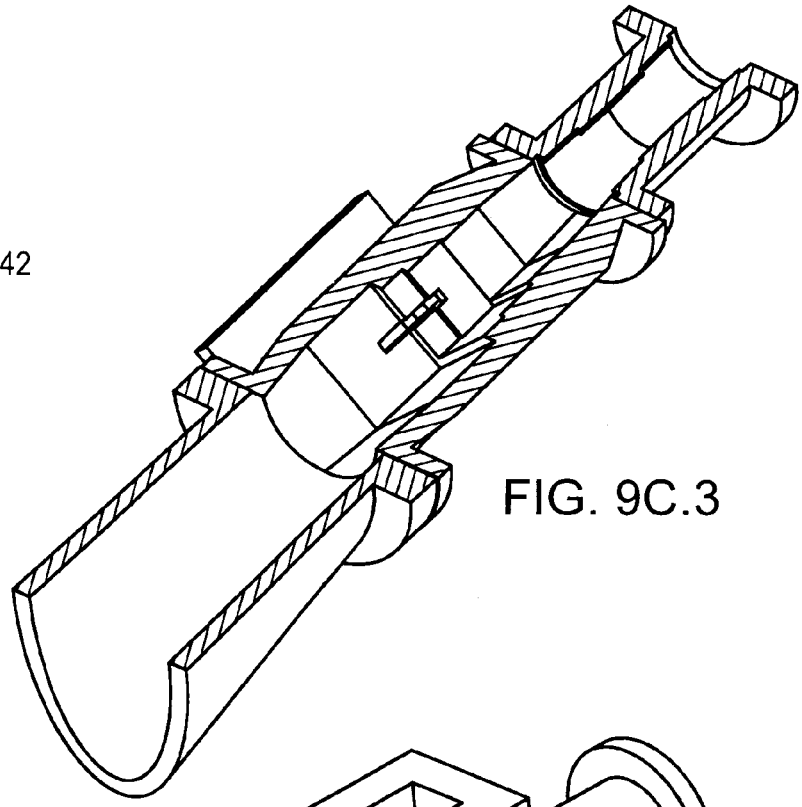
FIG. 9C.3
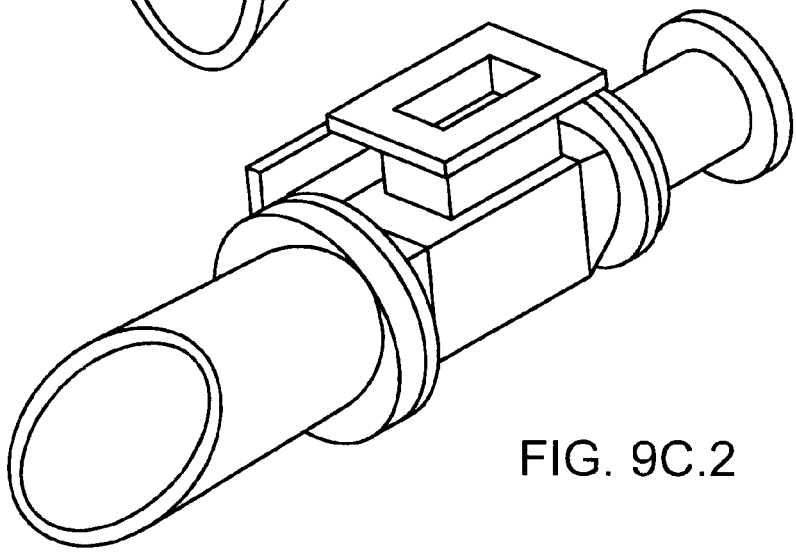
FIG. 9C.2

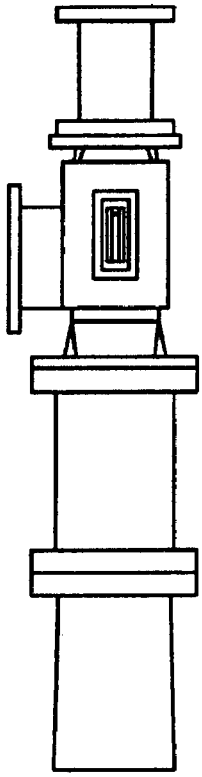
FIG. 9D.1
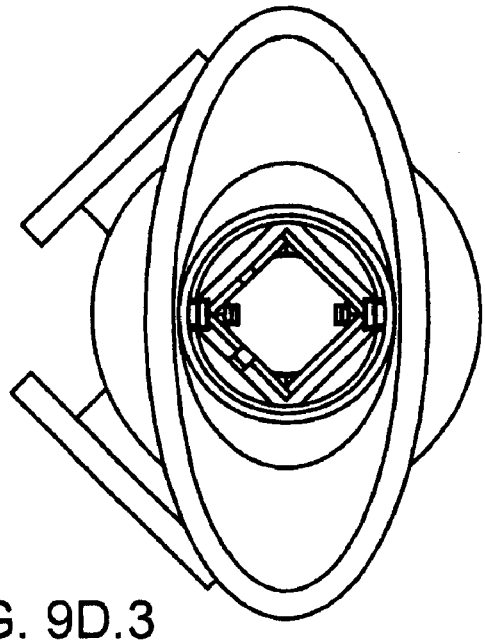
FIG. 9D.3
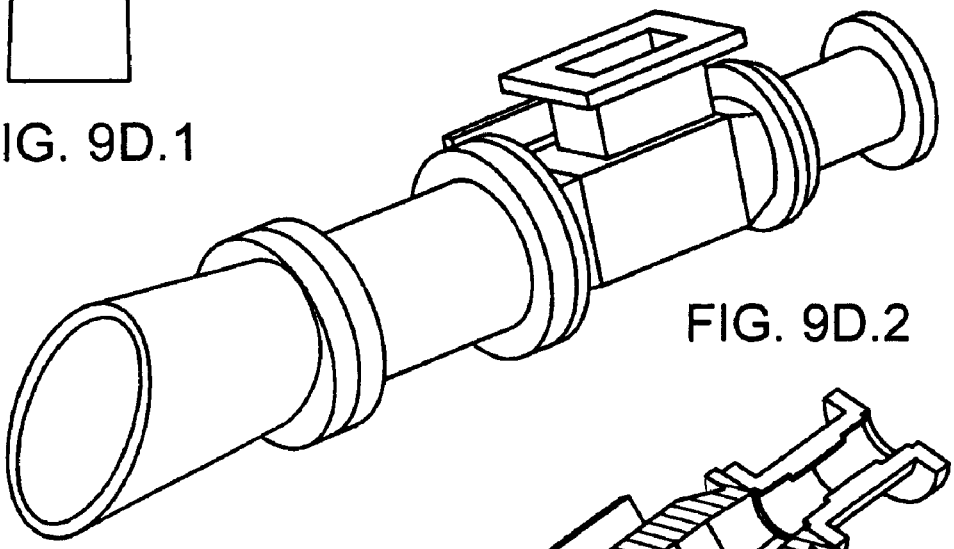
FIG. 9D.2
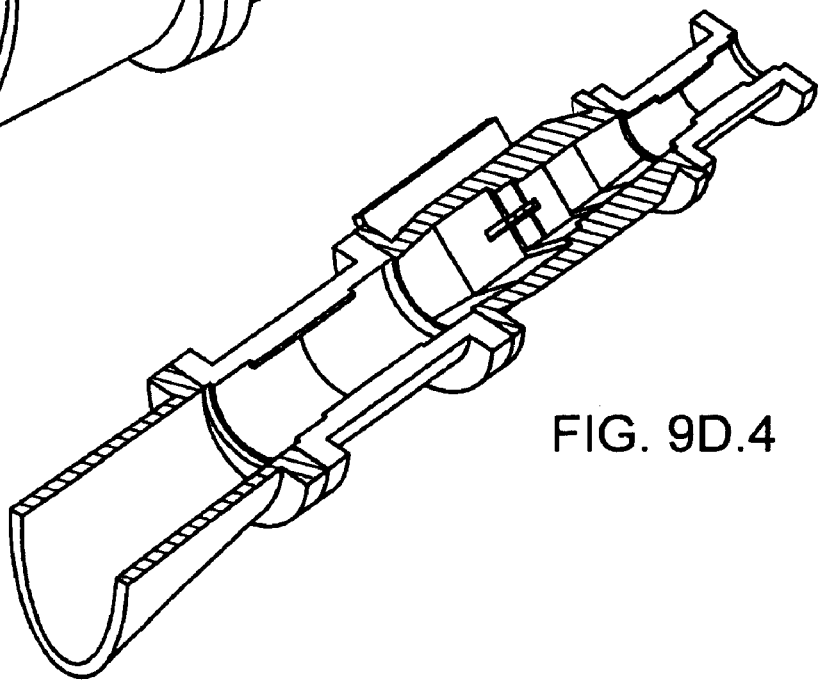
FIG. 9D.4

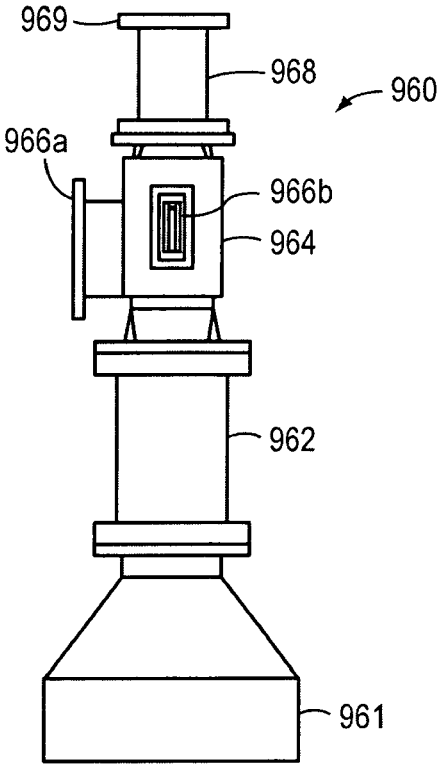
FIG. 9E.1
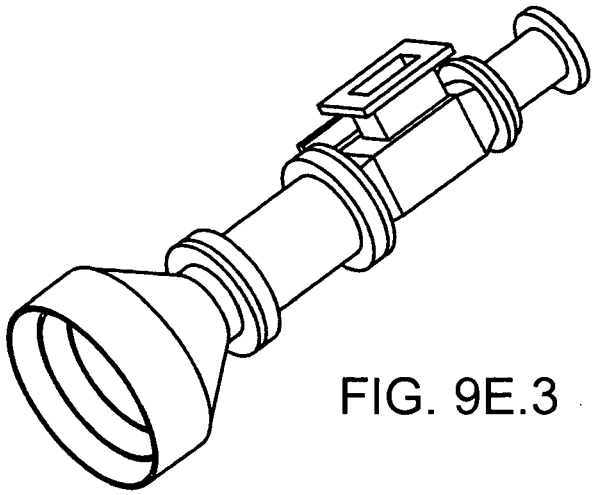
FIG. 9E.3
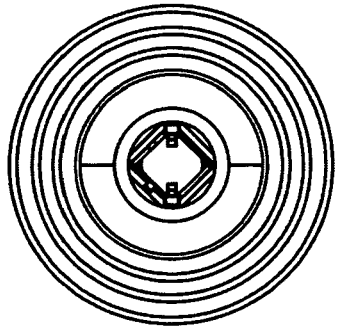
FIG. 9E.4
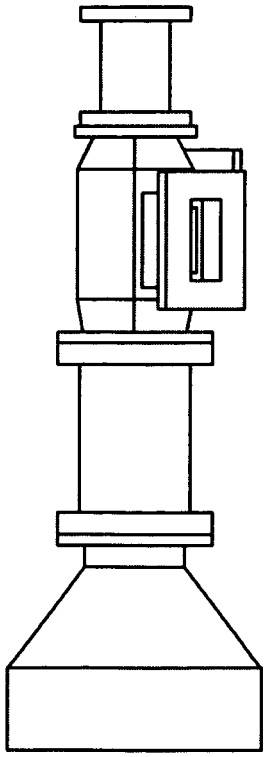
FIG. 9E.2
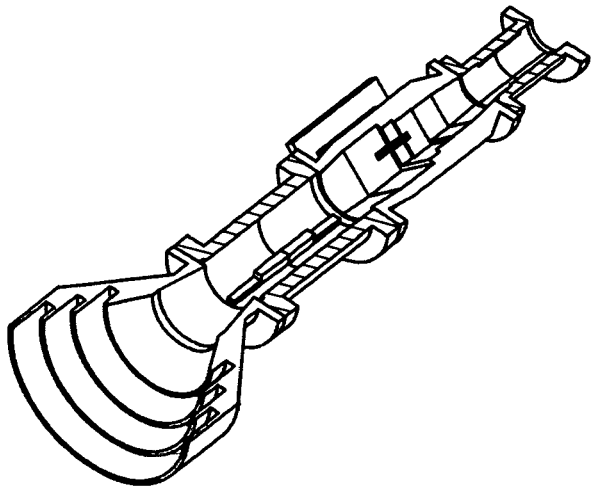
FIG. 9E.5

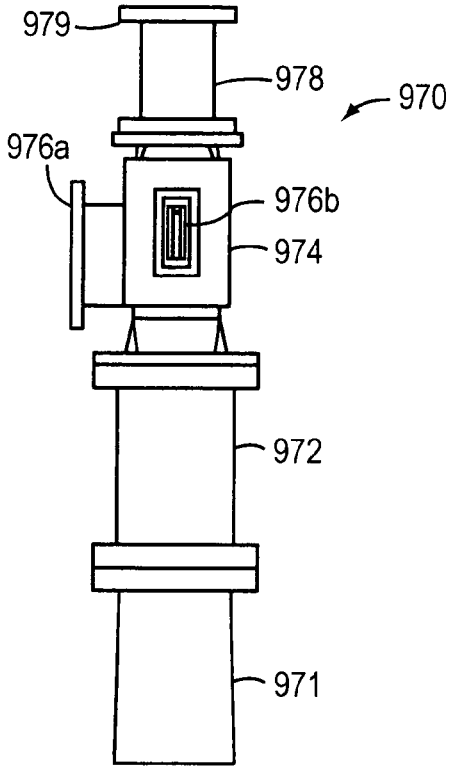
FIG. 9F.1
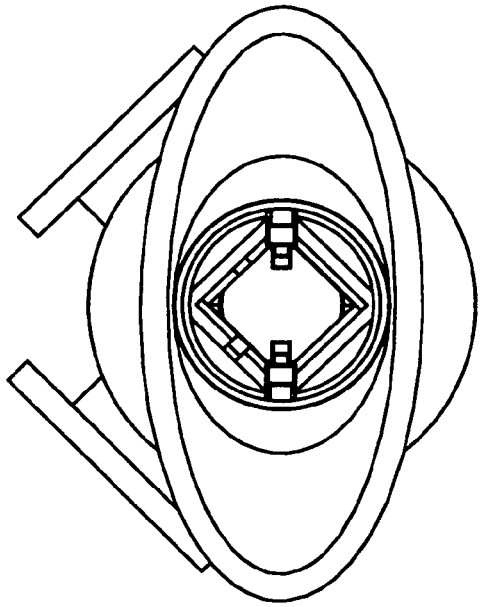
FIG. 9F.2
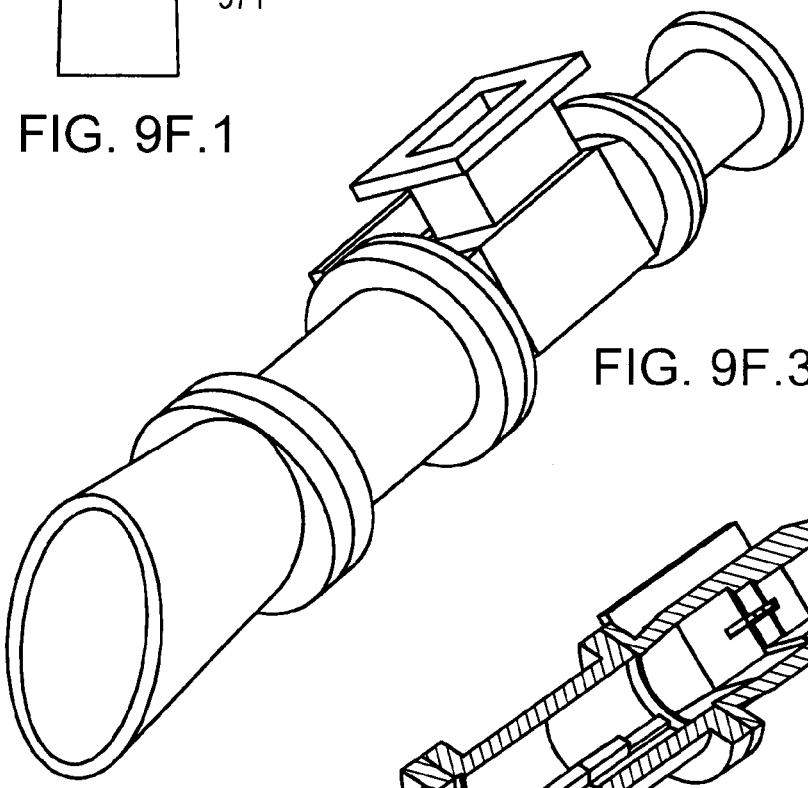
FIG. 9F.3
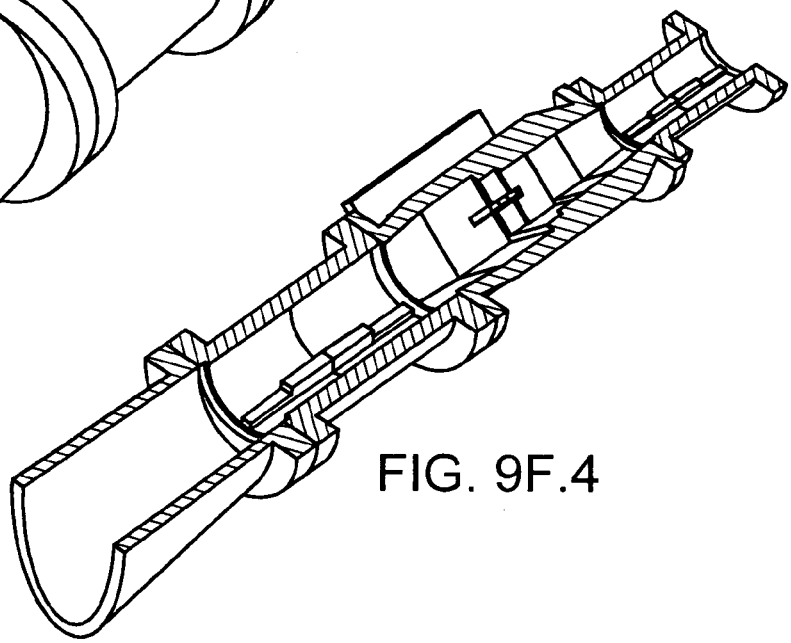
FIG. 9F.4

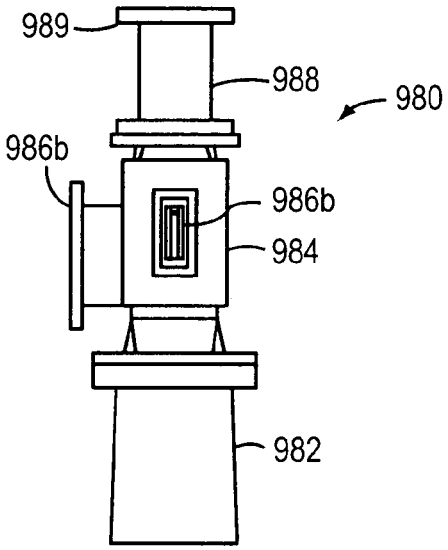
FIG. 9G.1
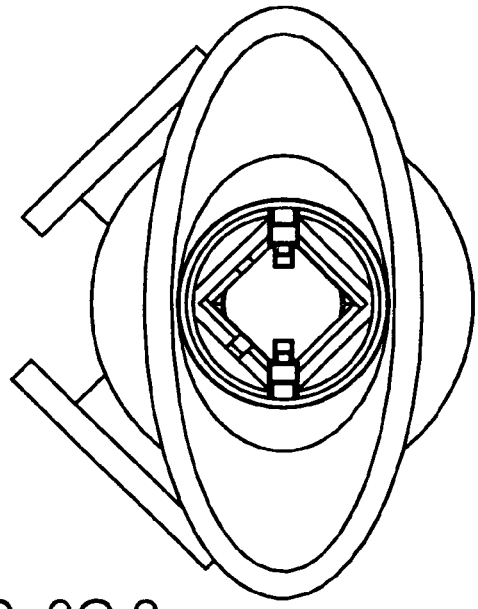
FIG. 9G.2
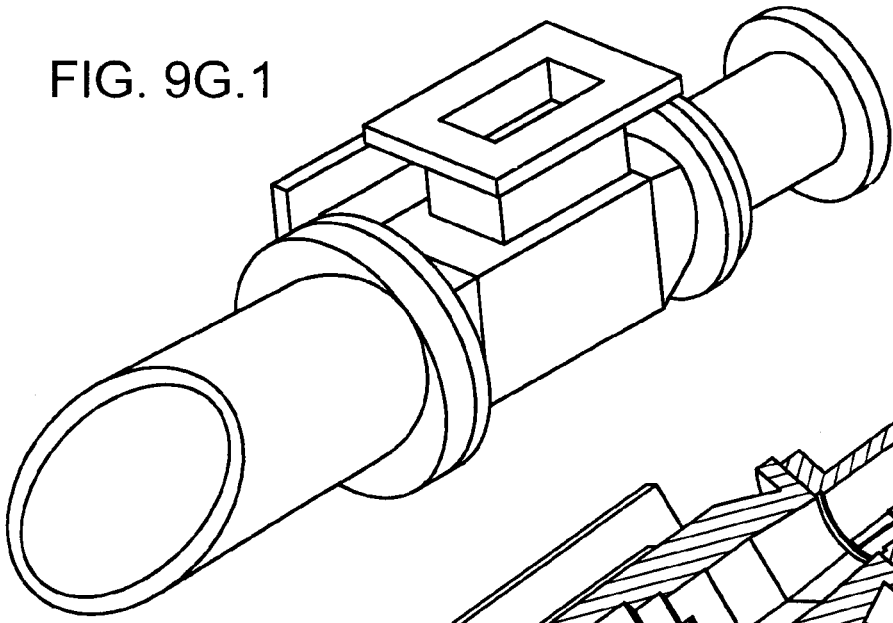
FIG. 9G.3
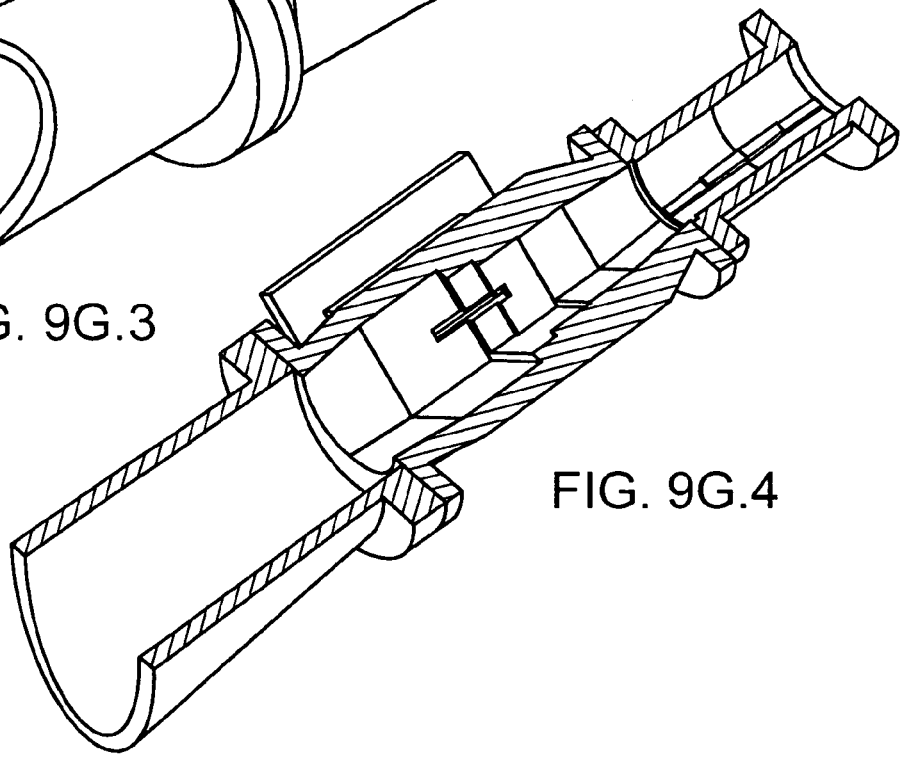
FIG. 9G.4

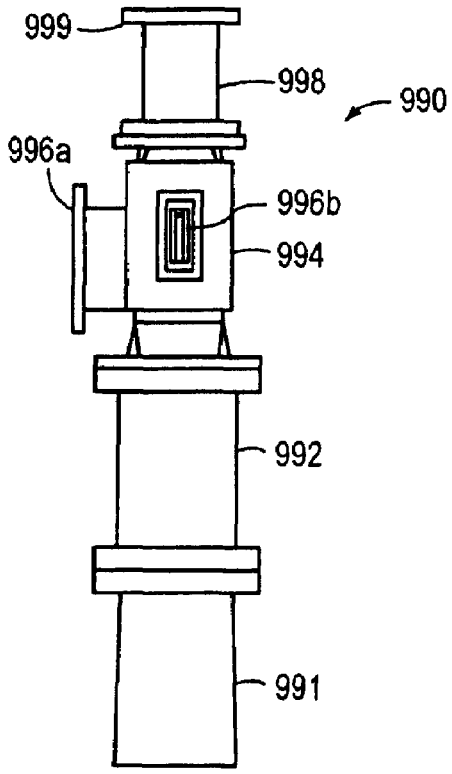
FIG. 9H.1
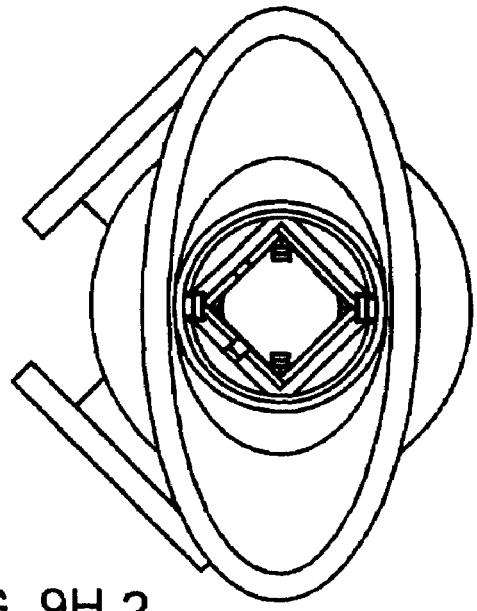
FIG. 9H.2
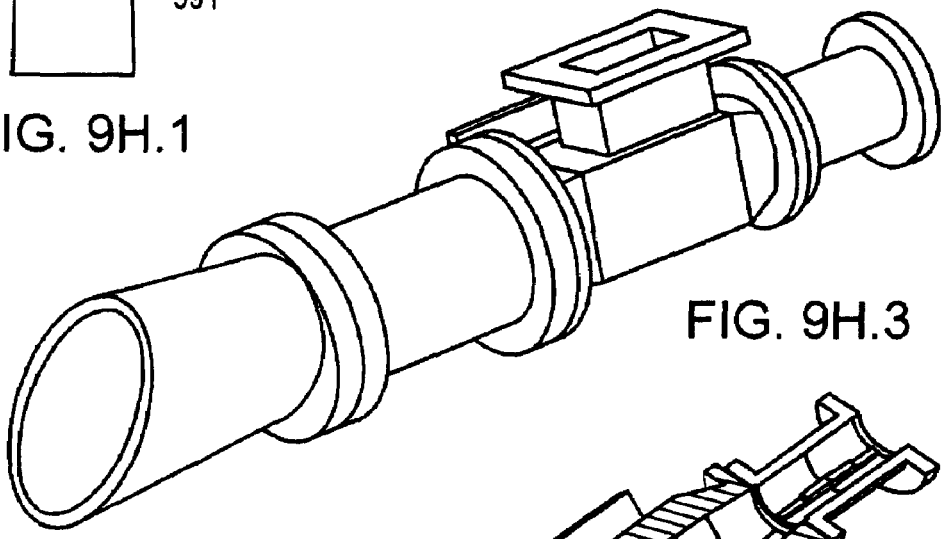
FIG. 9H.3
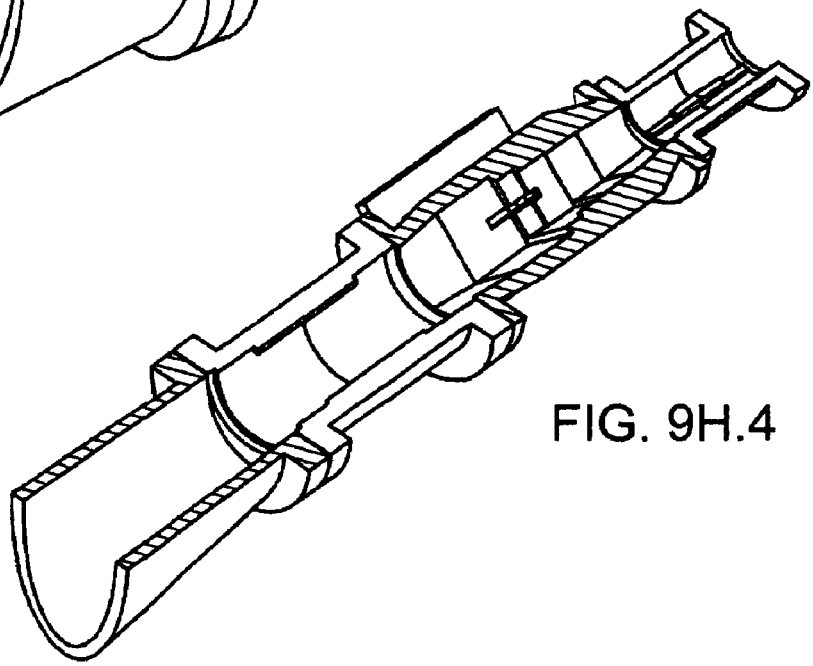
FIG. 9H.4

CIRCULAR POLARITY ELLIPTICAL HORN ANTENNA

REFERENCE TO RELATED APPLICATIONS

This application claims priority to commonly-owned copending U.S. Provisional Patent Application Ser. No. 60/572,080 entitled "Small Wave-Guide Radiators For Closely Spaced Feeds on Multi-Beam Antennas" filed May 18, 2004, which is incorporated herein by reference; and U.S. Provisional Patent Application Ser. No. 60/571,988 entitled "Circular Polarization Technique for Elliptical Horn Antennas" filed May 18, 2004, which is also incorporated herein by reference.

TECHNICAL FIELD

The present invention is generally related to antenna systems designed to receive broadcast signals with circular polarity and, more particularly, is directed to digital video broadcast satellite (DVBS) antenna systems.

BACKGROUND OF THE INVENTION

An increasing number of applications, such as digital video satellite broadcast television systems, utilize elliptical antenna reflectors to improve gain and interference rejection in desired directions. This is particularly true for ground-based antenna systems designed to receive from and/or transmit to geo-stationary satellites when other potential interfering satellites are closely spaced, for example on the order of two degrees away. Simply increasing a circular antenna's reception area improves gain and interference rejection in all directions. Increasing the antenna size should also be balanced against cost and aesthetic tradeoffs. Elliptical antenna reflectors strike a better balance between these competing design objectives by increasing the size of the antenna reflector more in the direction in which interference rejection is most critical. The resulting elliptical antennas maintain a relative small reflector size (collection area) while providing improved rejection of unwanted signals in the direction needed. This is typically accomplished by aligning the long axis of the antenna reflector with the geostationary arc. Elliptical reflectors can also be designed to improve the antenna's performance when multiple feeds are used to receive from or transmit to multiple locations (such as multiple satellites).

In general, elliptical antenna feed horns should be used in connection with elliptical reflectors in order to achieve optimum performance. Although elliptical antenna feed horns are somewhat more complex than ordinary circular feeds feed horns, there are a number of established design approaches for elliptical beam feeds. In addition, many applications are now using circular polarity. This is where the challenge arises. It is difficult to achieve good circular polarity cross polarization isolation (also referred to as x-polarization or x-pol isolation) when using an elliptical beam feed with a circular polarity polarizer (also referred to as a CP polarizer) approaches. The problem arises because an elliptical horn (or most any non-axially symmetric horn) introduces a differential phase shift between orthogonal electric fields that are parallel (or near parallel) to either the wide or narrow sides of the horn. The result is that when a circular polarity signal is received by an elliptical horn the asymmetries in the horn introduce a phase differential between the orthogonal fields, changing the circular polarity into elliptical polarity at the output of the horn. Simply attaching a conventional CP polarizer to a feed horn with an elliptical portion results in poor cross-polarization performance due to the differential phase and amplitude characteristics imparted by the elliptical portion of the feed horn.

The following additional background information will facilitate a more detailed discussion of CP polarizers and elliptical antenna feed horns. First it should be appreciated that that circular polarity can be expressed as the vector sum of two orthogonal linear components that are 90 degrees out of phase. For example, the orthogonal linear components can be referred to as +45FV0P (+45 degrees from vertical and 0 degrees phase reference) and −45FV+90P (−45 degrees from vertical and +90 degrees phase). A typical CP polarizer is lined up with the −45LP+90P component and delays that 45FV+90P component by 90 degrees so that it becomes in phase with the +45FV0P component. When this occurs the result is a theoretically lossless conversion of the received power conversion from circular polarity to linear polarity (vertical polarity in this case). This linear polarity can then be easily picked up with simple linear probe, wave-guide slot, etc. If both right hand circular polarity (RHCP) and left hand circular polarity LHCP beams are present, then the CP polarizer produces both vertical and horizontal linear polarity components.

Now consider a theoretically perfect circular polarity beam impinging on an elliptically shaped receiving horn as shown in FIGS. 1A-C. Again, recall that circular polarity can be expressed as the vector sum of two orthogonal linear components that are 90 degrees out of phase. For simplicity in this case, the orthogonal linear components will be taken to be H (horizontal) and V (vertical), where H is aligned with (parallel to) the x-axis, V is aligned with the y-axis, and the z-axis is the signal propagation direction through the horn, as expressed in terms of a conventional Cartesian coordinate system. As the circular polarity beam enters the horn, the elliptical shape of the horn causes the H and V components to travel at different phase velocities through the horn so the H and V components are no longer 90 degrees out of phase when they reach the end of the horn (at the start of the polarizer section). So elliptical polarity now exists at the start of the polarizer section. So a polarizer designed to convert circular polarity to linear polarity will have poor CP cross polarization (cross polarization) performance as shown in FIG. 1D.

As a design compromise, many elliptical reflector systems simply use circular beam feeds with conventional CP polarizers in an attempt to preserve good circular polarity cross polarization isolation. This approach is easy to implement but results in significant compromises (degradations) in efficiency, gain noise temperature, beam width, and side lobe performance of the reflector system, because the circular beam feeds do not properly illuminate the elliptical reflector. This situation is shown in FIG. 2, in which the antenna horn illumination level along the short axis of the reflector is too high resulting in large amounts of wasted spillover energy that degrades gain, efficiency, and noise temperature. In addition, the antenna horn illumination level along the long axis of the reflector is too low resulting in degraded taper efficiency and gain. In addition, this improper illumination makes it very difficult to achieve desired beam width and side lobe performance. That is, the high illumination along the short axis of the antenna degrades (raises) side lobes while the low illumination along the long axis of the antenna degrades (widens) beam widths. In addition, for multi-beam applications where a single reflector is used to receive from multiple beam sources (typically satellites) that are closely spaced, use of a circular feed increases the physical spacing required between the feeds, which limits the closeness of the beams that the antenna can receive.

There has been some work in the area of elliptical beam feed horns that provide circular polarization. U.S. Pat. No. 6,570,542 gives a vague description of an antenna horn that includes a divided elliptical horn section including a phase compensator in the form an "arc structure metal" that spans the entire major axis of the elliptical horn. It is not clear whether or not the "arc structure metal" is used to remove the phase differential introduced by the horn such that a conventional CP polarizer can be attached to it or if the "arc structure metal" is used in conjunction with the horn to achieve the proper phase differentials needed for CP polarizer thereby eliminating the need for a separate CP polarizer. Regardless, this metal structure complicates the manufacturability of the horn making it more difficult to die cast or machine. Also adding the arc through the middle of the horn might require the horn to be wider than desired for many applications.

Accordingly, there is an ongoing need for single and multi-beam elliptical antenna systems that exhibit improved efficiency, gain, interference rejection, gain noise temperature, beam width, side lobe, size and cost and other characteristics.

SUMMARY OF THE INVENTION

The present invention meets the needs described above in antenna feed horns and associated antenna systems for receiving circular polarity beams. This type of antenna system, which may be implemented with a single horn or one or more multiple-horn antenna feed blocks, are designed to achieve good circular polarity performance over broad and multiple frequency bands.

BRIEF DESCRIPTION OF THE DRAWINGS

FIGS. 9A1-9A5 show various views of a multi-band, multi-port antenna feed horn with a circular reception section, an initial phase differential section, a frequency diplexer, and an second additive phase differential section.

FIGS. 9B1-9B4 shows various views of a multi-band, multi-port antenna feed horn with an elliptical transition section, an initial oppositely sloped phase differential section, a frequency diplexer, and a second additive phase differential section.

FIGS. 9C1-9C3 shows various views of a multi-band, multi-port antenna feed horn with an integral elliptical reception and CP polarizer section, a frequency diplexer, and an additive phase differential section.

FIGS. 9D1-9D4 shows various views of a multi-band, multi-port antenna feed horn with an elliptical transition section, an initial additive phase differential section, a frequency diplexer, and a second additive phase differential section.

FIGS. 9E1-9E5 shows various views of a multi-band, multi-port antenna feed horn with a circular transition section, an initial phase differential section, a frequency diplexer, and an second oppositely sloped phase differential section.

FIGS. 9F1-9F4 shows various views of a multi-band, multi-port antenna feed horn with an elliptical transition section, an initial oppositely sloped phase differential section, a frequency diplexer, and a second oppositely sloped phase differential section.

FIGS. 9G1-9G4 shows various views of a multi-band, multi-port antenna feed horn with an integral elliptical reception and CP polarizer, a frequency diplexer, and an oppositely sloped phase differential section.

FIGS. 9H1-9H4 shows various views of a multi-band, multi-port antenna feed horn with an elliptical transition section, an initial additive phase differential section, a frequency diplexer, and an oppositely sloped phase differential section.

DETAILED DESCRIPTION OF THE PREFERRED EMBODIMENTS

Figure 1A:
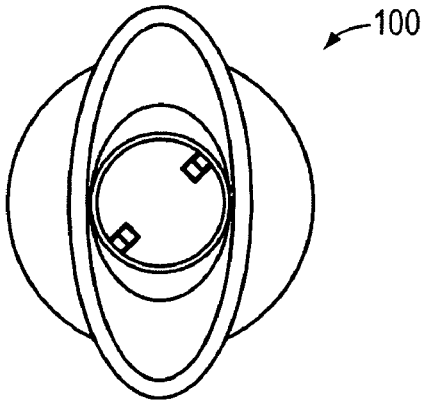
FIG. 1A PRIOR ART
FIG. 1A is a front view of a prior art antenna feed horn with an elliptical transition section and a conventional CP polarizer.

The present invention may be embodied in antenna feed horns and associated circular polarity antenna systems for single or multiple-beam antennas designed to achieve good circular polarity performance over broad and multiple frequency bands. In general, several methods of introducing the needed phase differential between orthogonal linear components can be used in the opposite slop phase differential section described for the antenna feed horn embodiment 600 (FIGS. 6A-B) including but not limited to using sections of elliptical, rectangular or oblong waveguides, septums, irises, ridges, screws, dielectrics in circular, square, elliptical rectangular, or oblong waveguides. In addition, the needed phase differential could be achieved by picking up or splitting off the orthogonal components via probes as in an LNBF or slots as in an OMT (or other means) and then delaying (via simple length or well establish phase shifting methods) one component the appropriate amount relative to the other component in order to achieve the nominal desired total 90 degrees phase differential before recombining.

Elliptically shaped horn apertures are described in many of the examples in this disclosure, however this invention can be applied to any device that introduces phase differentials between orthogonal linear components that needs to be compensated for in order to achieve good CP conversion and cross polarization (x-pol) isolation including but not limited to any non-circular beam feed, rectangular feeds, other types of oblong feeds, contoured corrugated feeds, feed radomes, specific reflector optics, reflector radomes, frequency selective surfaces etc.

To simplify the discussions, examples in this disclosure primarily refer to reception of signals and also generally referred to a single sense of circular polarity. However reciprocity applies to all of these embodiments given they are generally low loss passive structures. Furthermore the horns, CP polarizers and phase compensation sections obviously support both senses of CP (RHCP and LHCP). If both senses are impinging on the horn then they will be converted to two orthogonal linear polarities that can be easily picked up with two orthogonal probes and/or slots etc. For example, the approaches described for the antenna feed embodiment 400 (FIGS. 4A-B) and embodiment 600 (FIGS. 6A-B) can be used for systems transmitting and/or receiving power in any combination of circular polarities: single CP or Dual CP for each band implemented including multiple widely spaced bands for the embodiments shown in FIGS. 9A.1-9H.4.

It should be pointed out that for simplicity, specific phase values were often given in the examples, but the phase compensation concepts explained above are general. For example, the following applies to embodiment 600 (FIGS. 6A-B): If the elliptical horn introduces X degrees phase differential then the opposite slop phase differential section should introduce 90−X degrees so that the total introduced phase differential is 90 degrees=X−(90−X).

For simplicity the inventor provides examples using a nominal 90 degrees phase differential between orthogonal linear components as the target for achieving CP conversion. However it is understood that a nominal −90 degrees or any odd integer multiple of −90 or 90 degrees will also achieve good CP ( . . . −630, −450, −270, −90, 90, 270, 450, 630 etc.) and this invention covers those cases as well. As an example for embodiment 600 (FIGS. 6A-B) the horn could introduce a 470 degrees phase differential and the opposite phase slop section could introduce a −200 degrees phase differential resulting in a total 270 degrees phase differential.

In addition, a skilled antenna designer will understand that the term "CP polarizer" is not limited to a device achieving a theoretically perfect conversion from circular polarity to linear polarity, but instead includes devices that achieves a conversion from circular polarity to linear polarity within acceptable design constraints for its intended application.

Figure 1B:
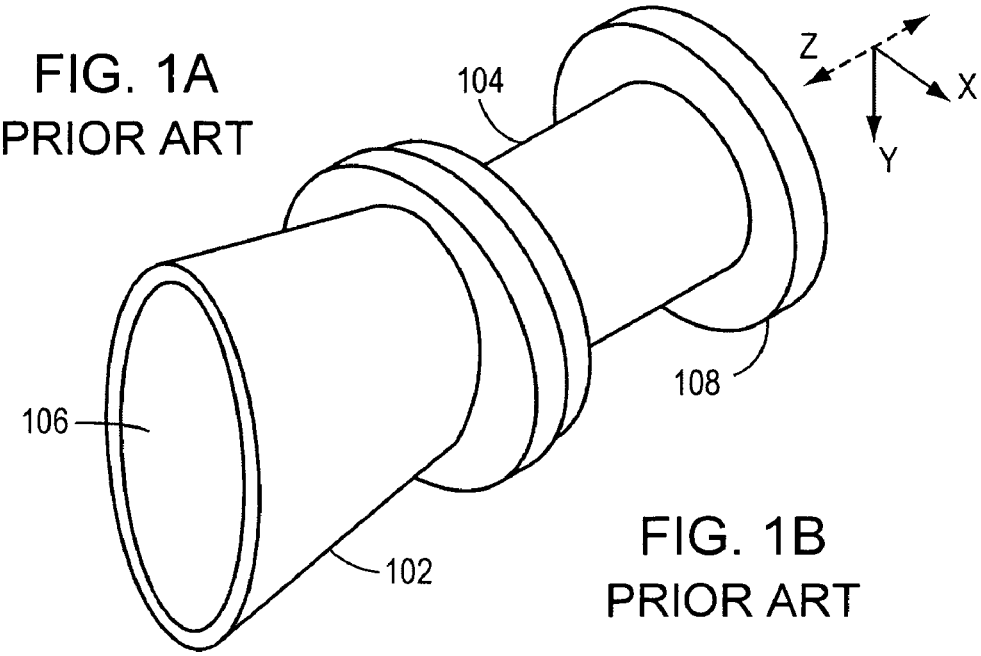
FIG. 1B PRIOR ART
FIG. 1B is a perspective view of the antenna horn of FIG. 1*a*, which also shows a Cartesian coordinate system that serves as a frame of reference.
Figure 1C:
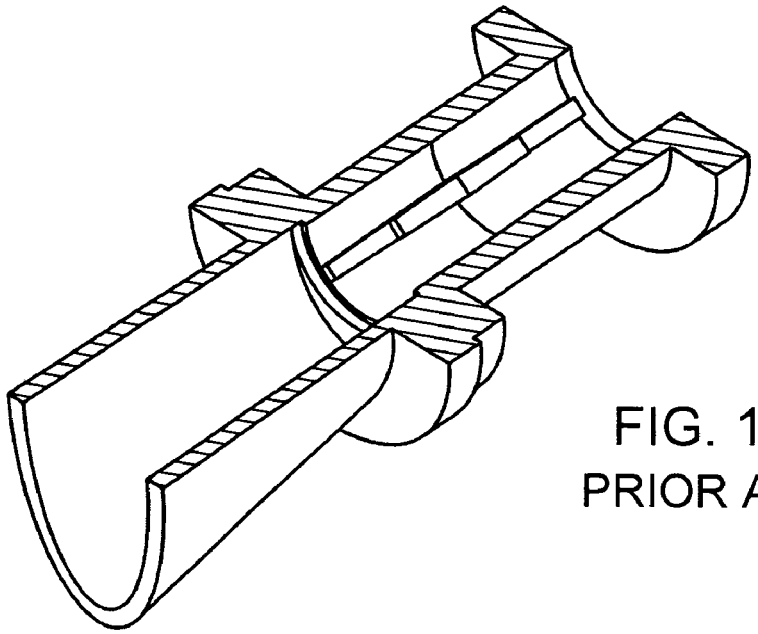
FIG. 1C PRIOR ART
FIG. 1C is a cross-sectional perspective view of the antenna horn of FIG. 1*a*.

Referring now to the figures, FIGS. 1A-C show a prior art antenna feed horn 100 with an elliptical receiving cone and transition section 102 feeding into a conventional CP polarizer 104. The transition section 102 extends from an aperture 106 at the front of the horn to the front of the front of the CP polarizer 104, which extends to a waveguide port 108 where linear polarity pickups are located. As a result, this, configuration is intended to produce a linear polarity signal at the waveguide port 108 but fails to take into account a 30 degree differential phase shift imparted by the transition section 102. This results in poor cross-pole (x-pol) isolation, as shown FIG. 1D, which is graphical illustration 120 of the circular polarity cross-polarization isolation characteristic of the antenna horn 100.

Figure 2:
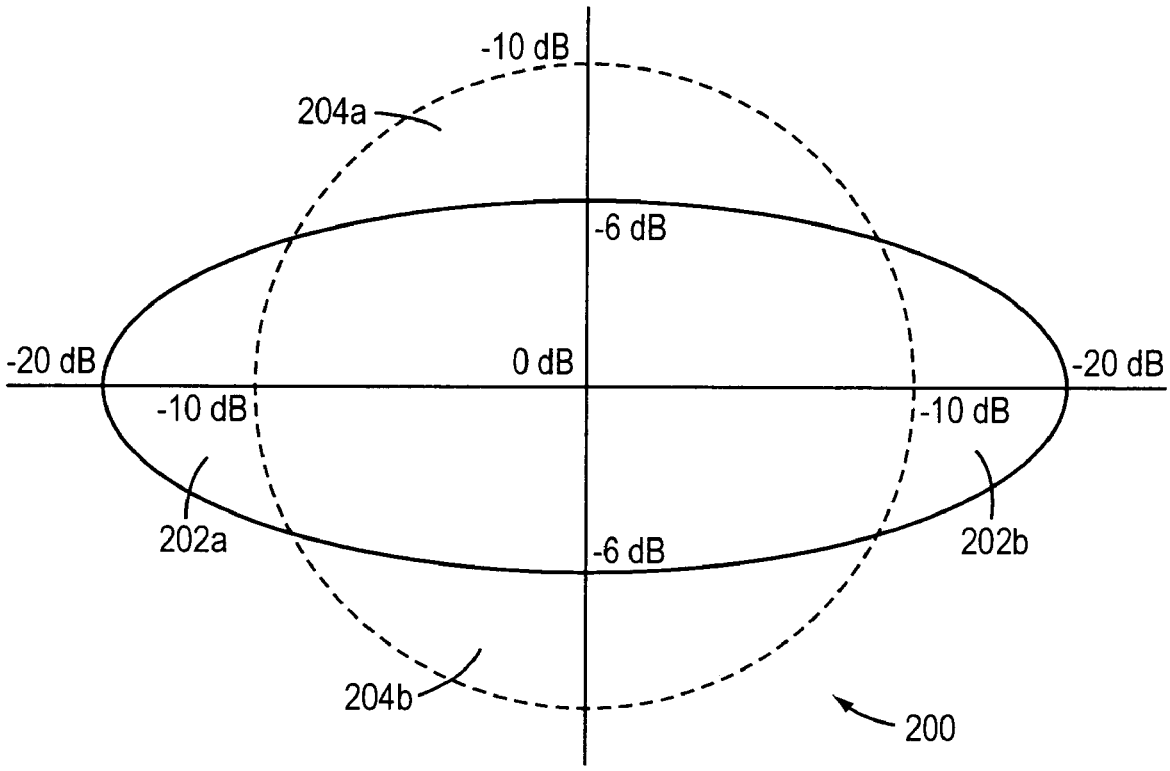
FIG. 2 PRIOR ART
FIG. 2 is a graphical representation of a prior art configuration illustrating the improper illumination that results from the use of a circular antenna feed horn with an elliptical reflector.
Figure 3A:
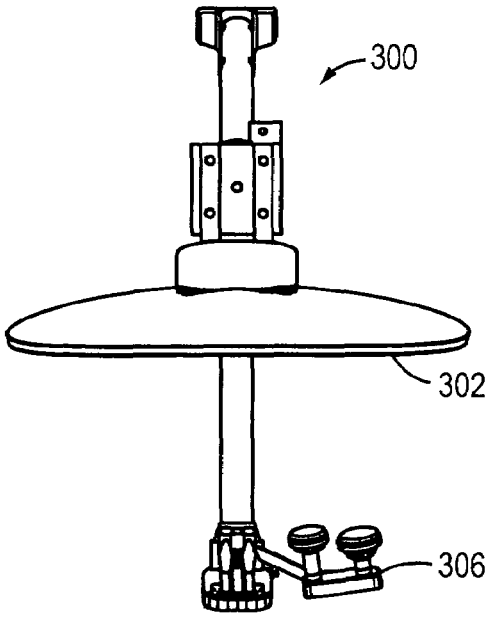
FIG. 3A is a top view of an antenna system including an elliptical reflector, a centrally located three-horn antenna feed block, and an off-center or outrigger two-horn antenna feed block.
Figure 3B:
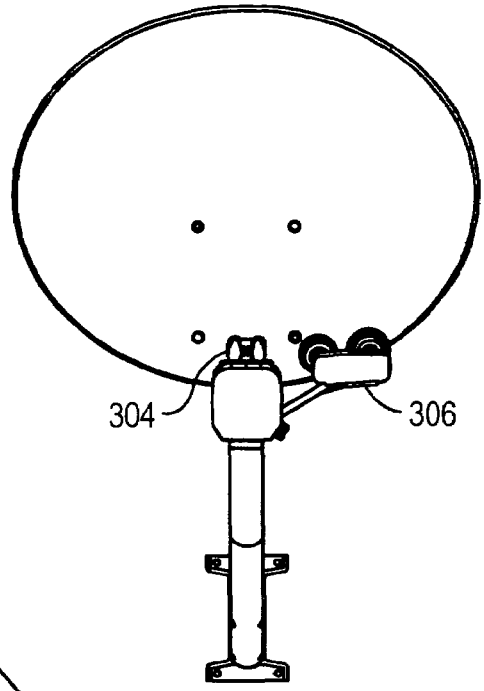
FIG. 3B is a front view of the antenna system of FIG. 3A.
Figure 3C:
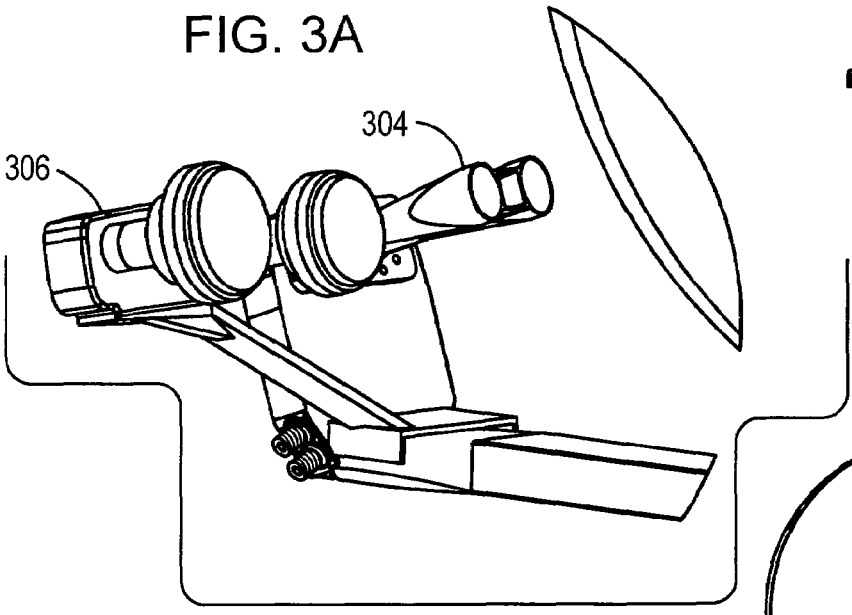
FIG. 3C is a perspective view of the feed horn structures of the antenna system of FIG. 3A.
Figure 3D:
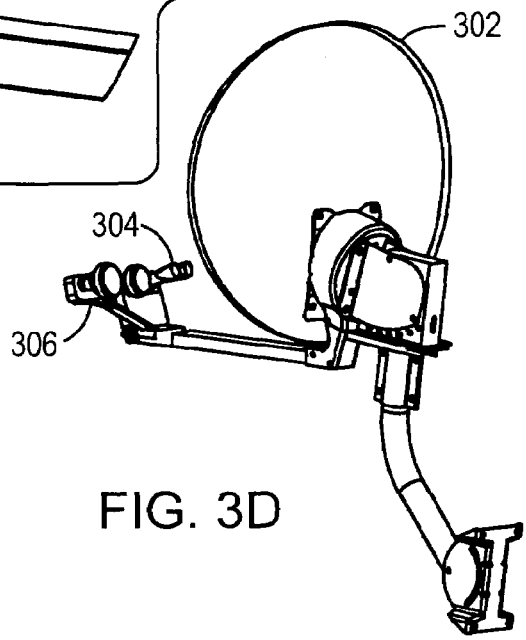
FIG. 3D is a rear perspective view of the antenna system of FIG. 3A.

FIG. 2 is a graphical representation 200 of a prior art configuration illustrating the improper illumination that results from the use of a circular antenna feed horn with an elliptical reflector. The mismatched areas 202*a-b* represent areas of wasted energy in the receive mode caused by under-illumination along the long axis of the elliptical reflector by the circular feed horn. Similarly, the mismatched areas 204*a-b* represent areas of wasted illumination by the circular feed horn in areas along the short axis of the elliptical reflector that extend beyond the physical perimeter of the reflector. This is also referred to as over-illumination spill-over energy.

FIGS. 3A-D show an antenna system 300 including an elliptical reflector 302, a centrally located three-horn antenna feed block 304, and an off-center or outrigger two-horn antenna feed block 306. Any of the feed horns described in this specification can be used in any of these locations. For example, the integral three-horn feed block 1000 described with reference to FIGS. 10A-B may serve as the centrally located three-horn antenna feed block 304, and the outrigger horns 306 may be conventional corrugated feed horns.

Figure 4A:
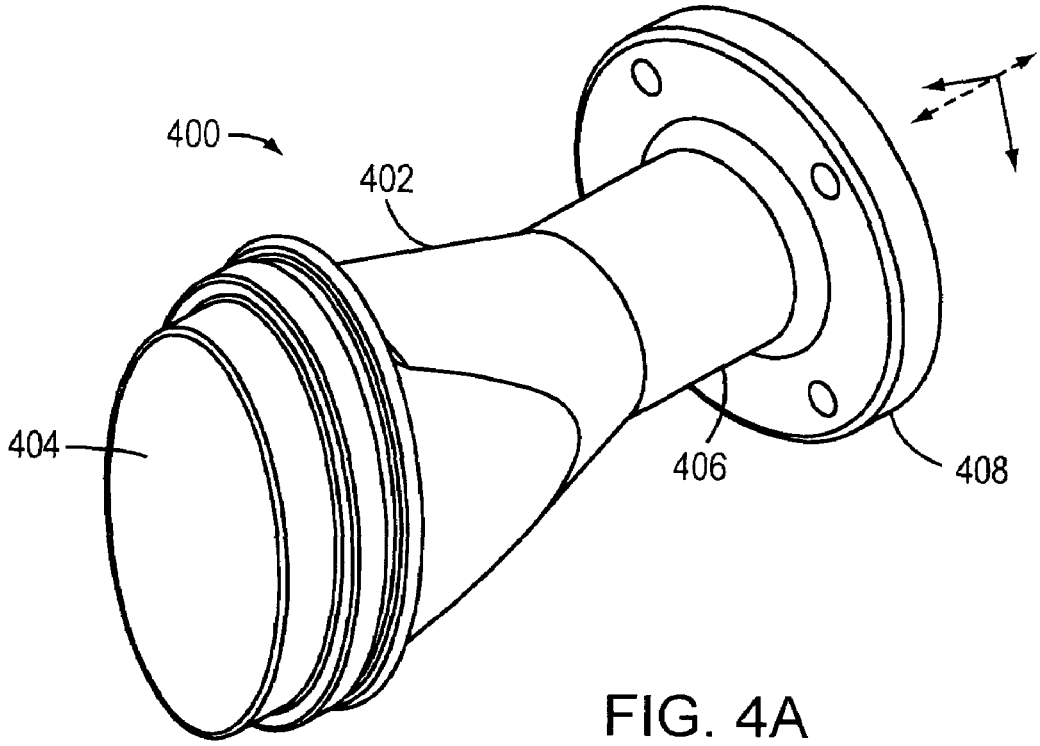
FIG. 4A is a perspective view of an elliptical antenna feed horn that functions as a CP polarizer.
Figure 4B:
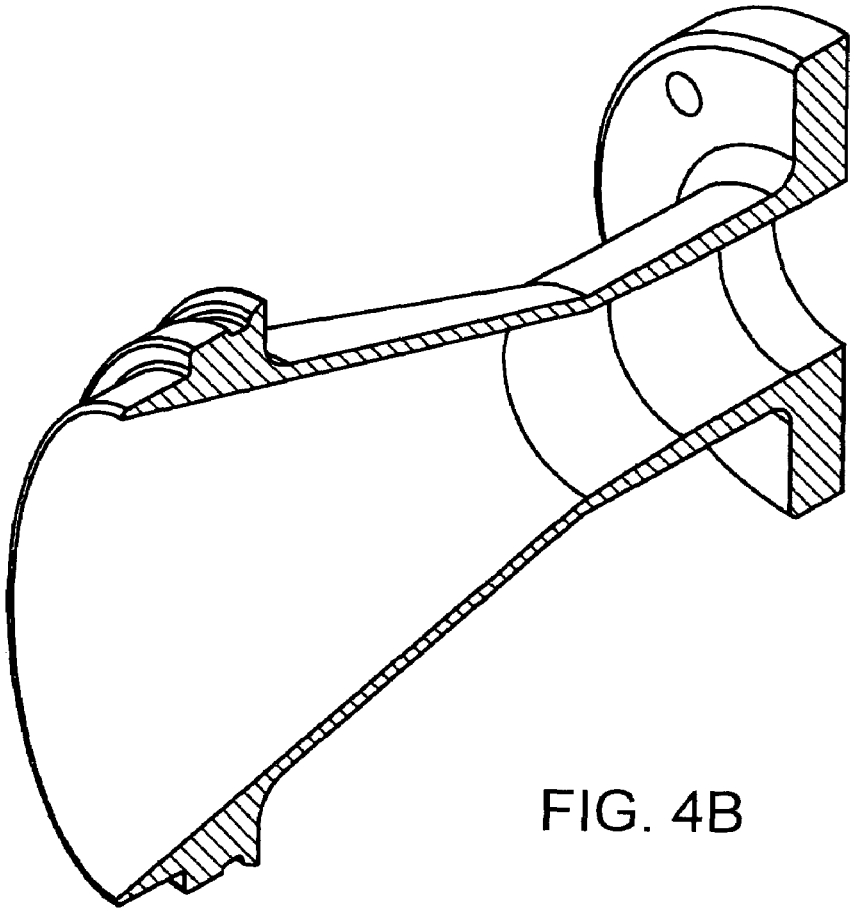
FIG. 4B is a cross-sectional perspective view of the antenna horn of FIG. 4A.
Figure 4C:
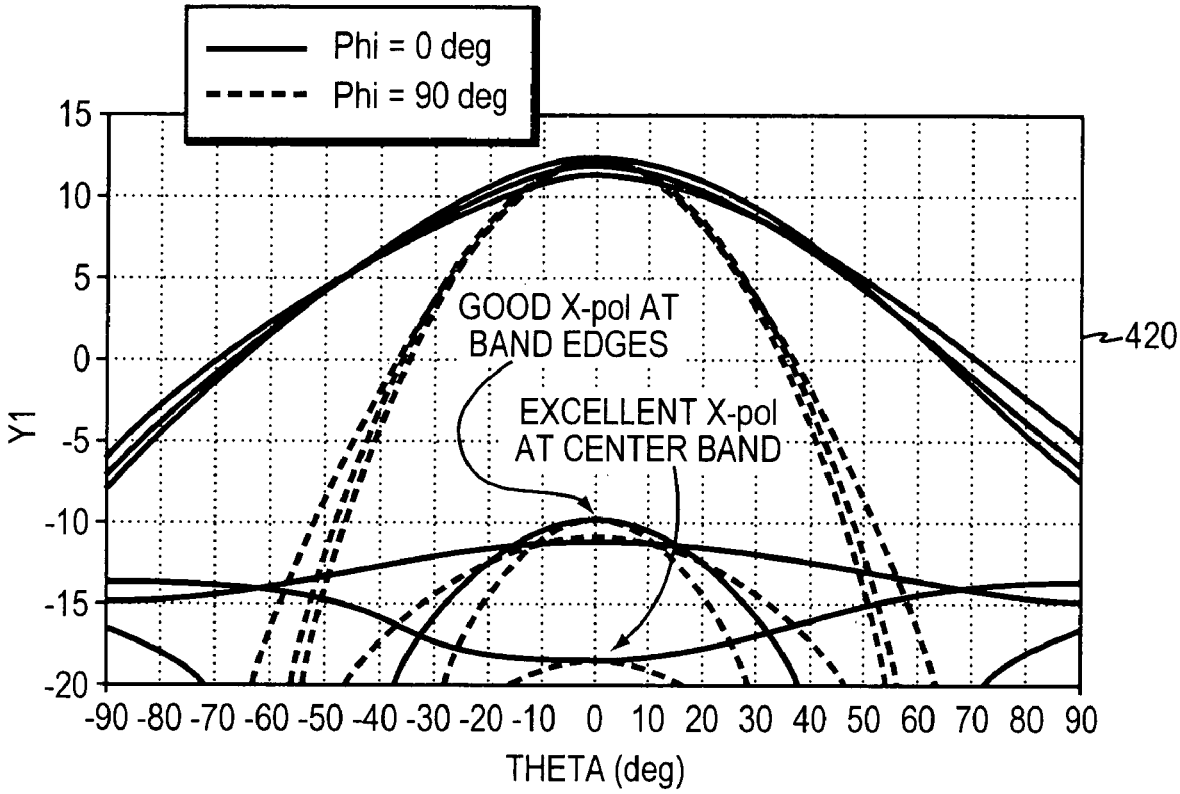
FIG. 4C is a graphical illustration of the circular polarity cross-polarization isolation characteristic of the antenna horn of FIG. 4A.

FIGS. 4A-B show an elliptical antenna feed horn 400 with a phase adjustment structure that includes an elliptical reception cone and transition section 402 extending from an aperture 404 at the reception end of the feed horn to a circular throat section 406, which leads to the waveguide port 408, where the linear polarity pickups are located. The transition section 402 functions as a 90 degree CP polarizer, whereas the throat section 406 does not impart any differential phase shift on the propagating signal. As a result, the feed horn 400 functions as a CP polarized without the need for any additional polarizing elements. This is accomplished by carefully selecting the height, width, length, flare angle and internal profile of the transition section 402. Note that the flare angle need not be constant or smooth, and that the transition section could include flared or circular stages and other types of steps so long as the end result is a 90 degree differential phase shift as the incident CP beam travels through the transition section. FIG. 4C is a graphical illustration 420 of the circular polarity cross-polarization isolation characteristic of the antenna horn 400. Comparing this result to the graphical illustration 120 for the prior art antenna horn 100 shows the greatly improved x-pol isolation characteristic achieved by the horn 400.

Figure 5A:
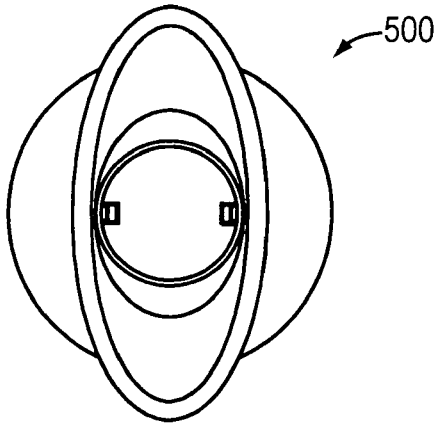
FIG. 5A is front view of an antenna horn with an elliptical transition section and an additive phase differential section.
Figure 5B:
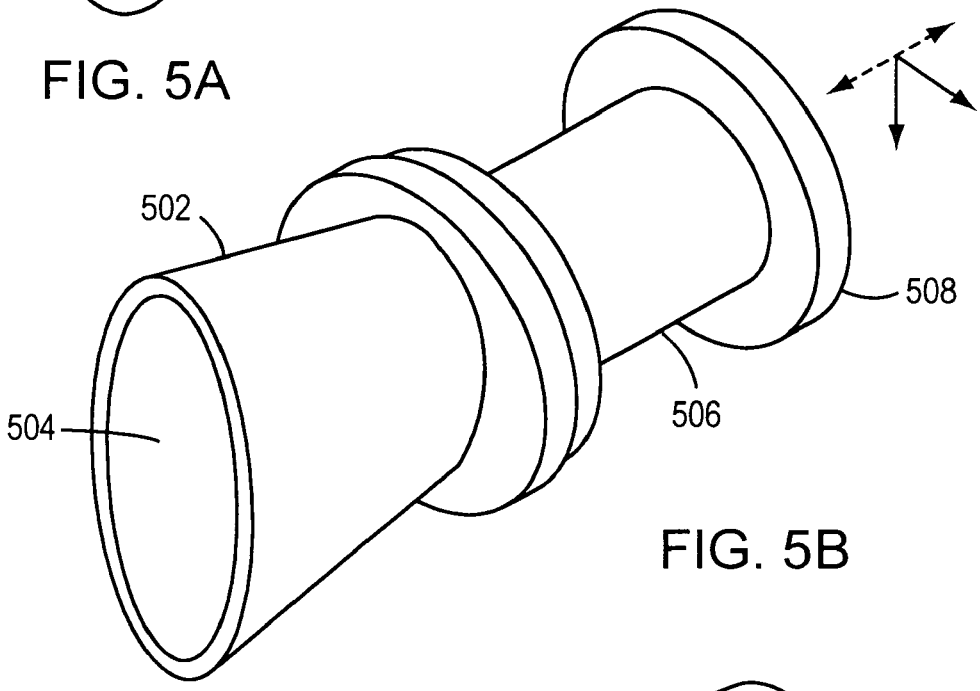
FIG. 5B is a perspective view of the antenna horn of FIG. 5A.
Figure 5C:
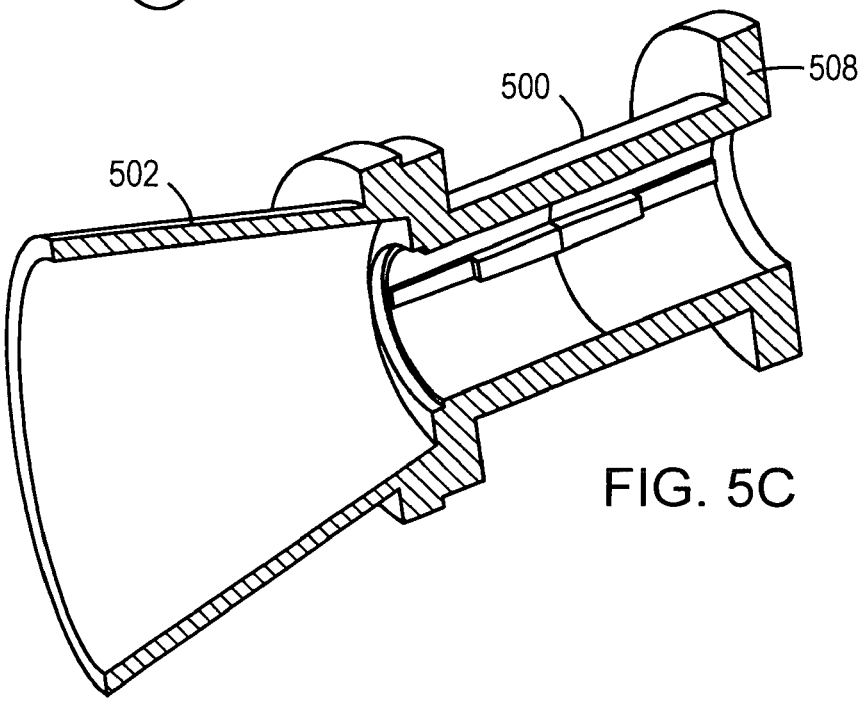
FIG. 5C is a cross-sectional perspective view of the antenna horn of FIG. 5A.
Figure 5D:
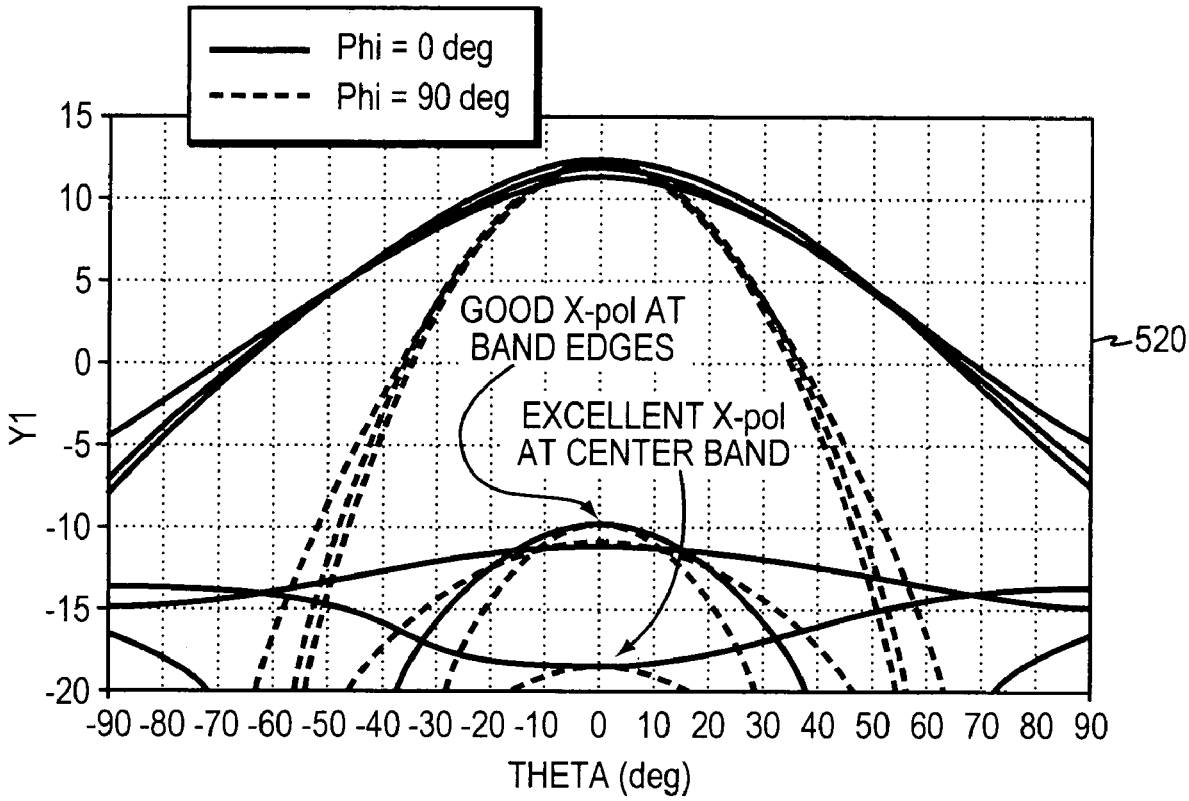
FIG. 5D is a graphical illustration of the circular polarity cross-polarization isolation characteristic of the antenna horn of FIG. 5A.

FIGS. 5A-C show an antenna horn 500 with a phase adjustment structure that includes an elliptical reception cone and transition section 502 leading from an aperture 504 to an additive phase differential section 506, which leads to the waveguide port 508, where the linear polarity pickups are located. In this embodiment, the transition section 502 imparts a less-than-need differential phase shift of 35 degrees and the additive phase differential section 506 imparts a differential phase shift of 55 degrees in the same direction (i.e., +55 degrees additive) as the transition section. Thus, the end result is a 90 degree differential phase shift through the horn 500, which produces good x-pol isolation at the linear polarity pickups, as shown by the graphical illustration 520 shown in FIG. 5D. Again, comparing this result to the graphical illustration 120 for the prior art antenna horn 100 shown in FIGS. 1A-C illustrates the greatly improved x-pol isolation characteristic achieved by the horn 500.

Figure 6A:
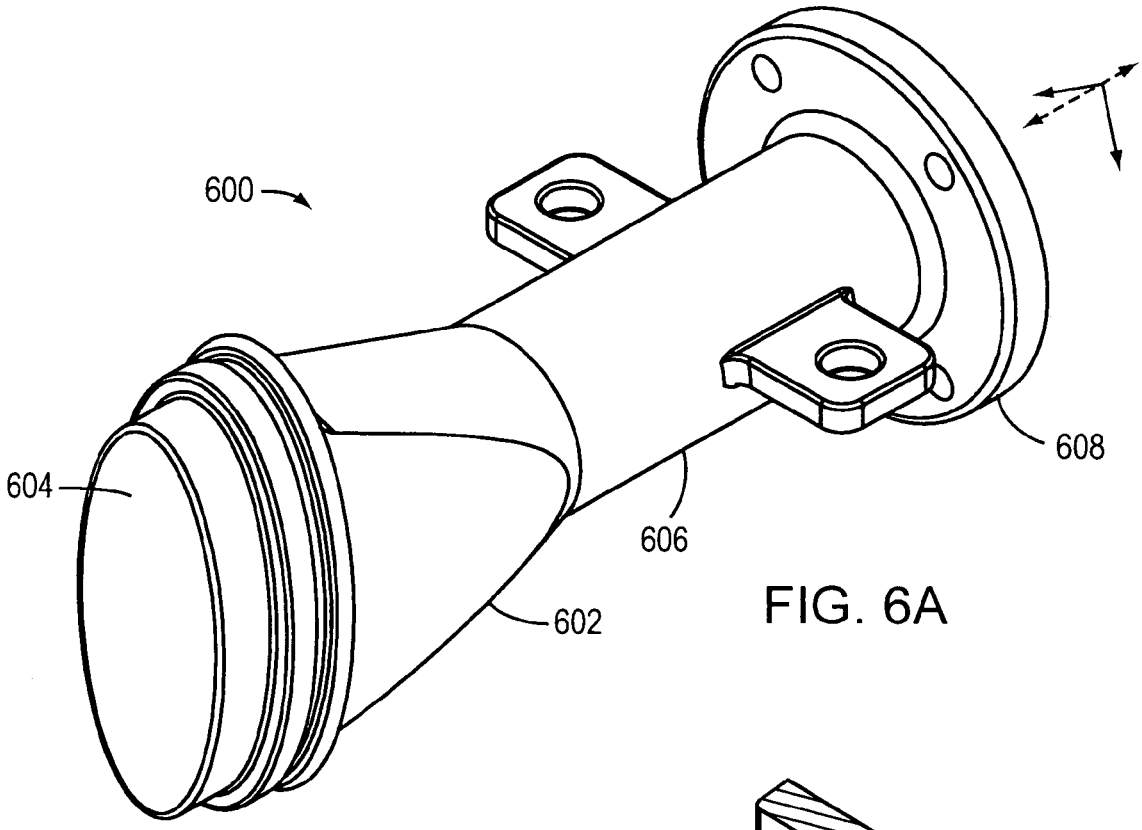
FIG. 6A is perspective view of an antenna horn with an elliptical transition section and an oppositely sloped phase differential section.
Figure 6B:
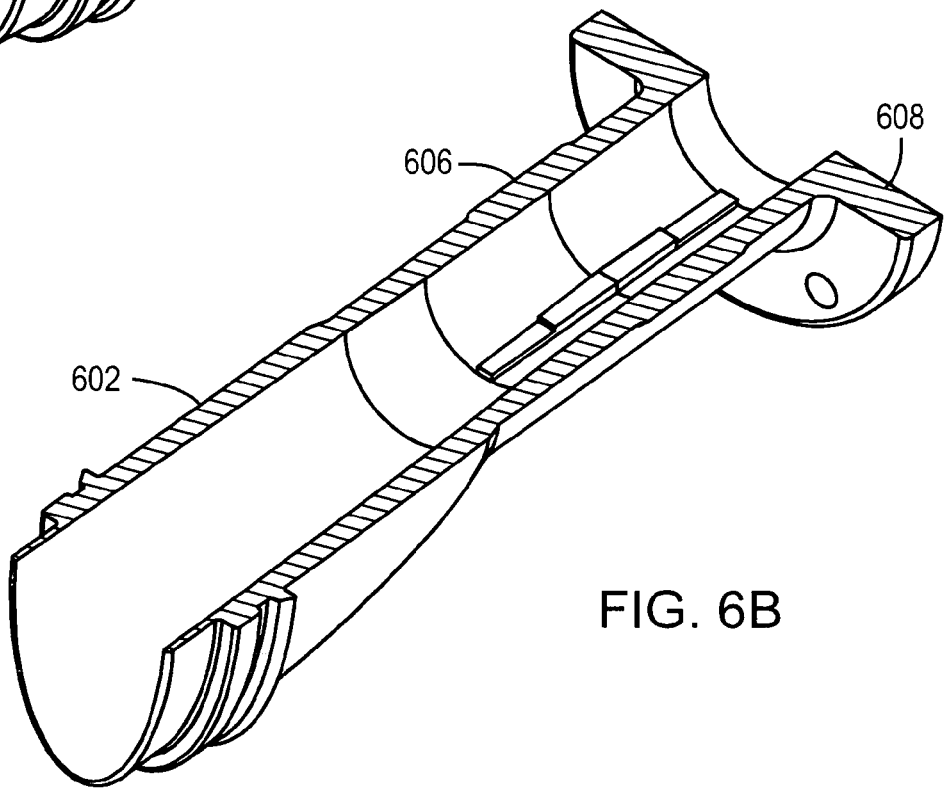
FIG. 6B is a cross-sectional perspective view of the antenna horn of FIG. 6A.
Figure 6C:
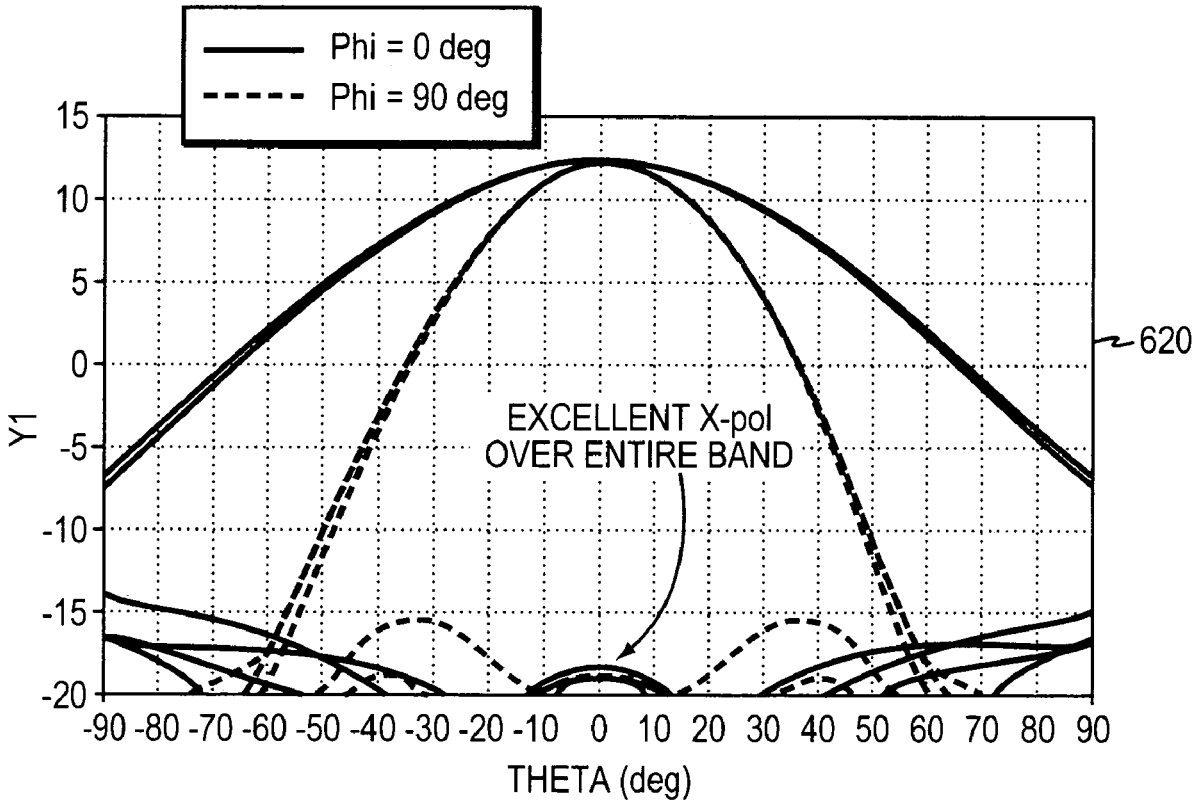
FIG. 6C is a graphical illustration of the circular polarity cross-polarization isolation characteristic of the antenna horn of FIG. 6A.

FIGS. 6A-C show an antenna horn 600 with a phase adjustment structure that includes an elliptical reception cone and transition section 602 leading from an aperture 604 to an oppositely sloped phase differential section 606, which leads to the waveguide port 608, where the linear polarity pickups are located. In this embodiment, the transition section 602 imparts a greater-than-needed differential phase shift of 130 degrees and the oppositely slopes phase differential section 606 imparts a differential phase shift of 40 degrees in the opposite direction (i.e., −40 degrees subtractive) as the transition section. Thus, the end result is a 90 degree differential phase shift through the horn 600, which produces good x-pol isolation at the linear polarity pickups, as shown by the graphical illustration 620 shown in FIG. 6C. Importantly, comparing this result to the graphical illustration 420 (FIG. 4C) and 520 (FIG. 5D) for the antenna horns 400 and 500 show the greatly improved x-pol isolation characteristic achieved by the horn 600 over a much wider frequency bandwidth.

Figure 7:
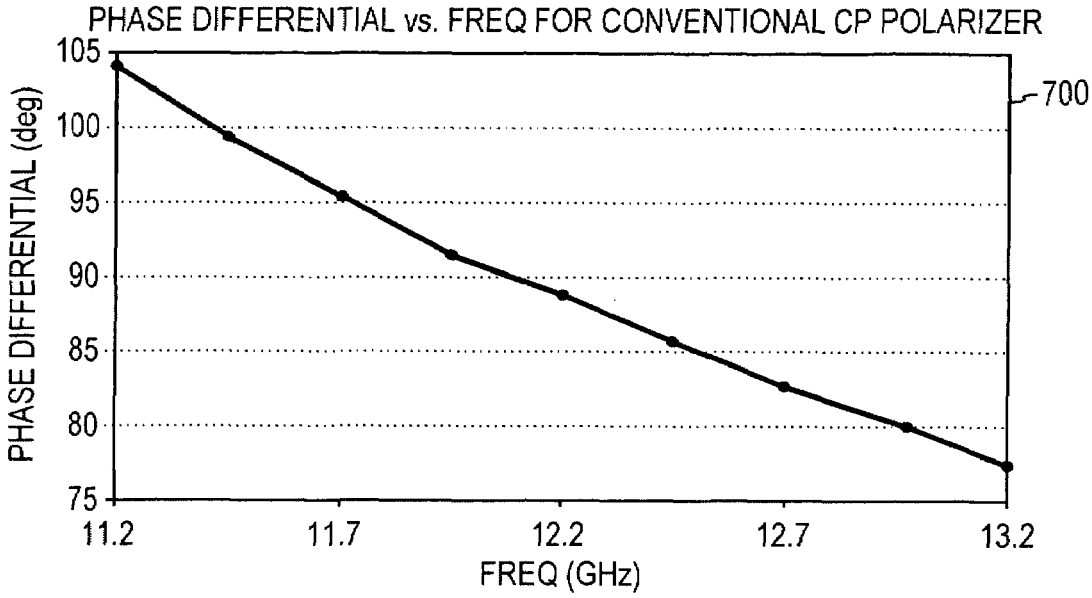
FIG. 7 PRIOR ART
FIG. 7 is a phase differential versus frequency plot for a typical CP polarizer illustrating the phase differential slope across a frequency band.
Figure 8:
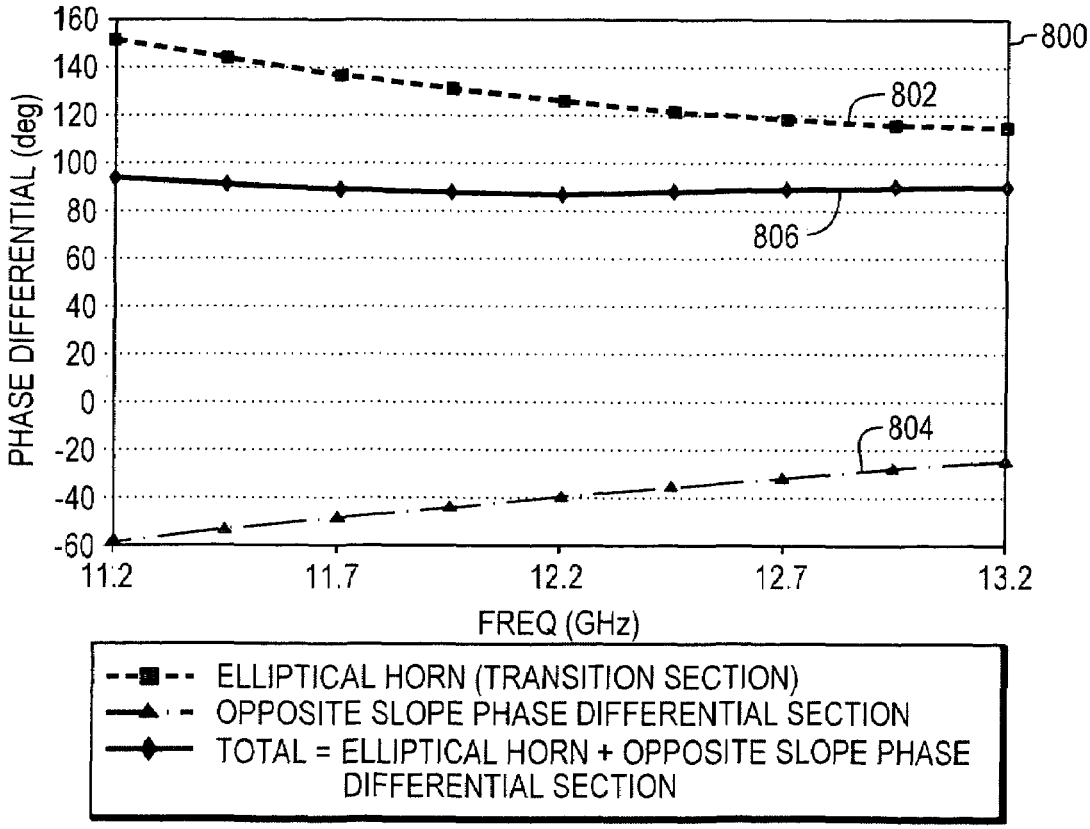
FIG. 8 is a phase differential versus frequency plot for the antenna horn shown in FIGS. 6A-C illustrating the broad band response improvement resulting from the oppositely sloped phase differential section.

FIG. 7 is a phase differential versus frequency plot 700 for a typical prior art CP polarizer illustrating its phase differential slope across its intended frequency band. FIG. 8 is a phase differential versus frequency plot 800 for the antenna feed horn 600. The curve 802 represents the phase differential characteristic for the transition section 602 and the curve 804 represents the phase differential characteristic for the oppositely sloped phase differential section 606. The combination of these two differential phase characteristics produces the total phase differential curve 806 through the horn 600, which shows the greatly improved CP polarization performance achieved by this horn (i.e., nearly 90 degrees differential phase shift) over a much wider frequency bandwidth.

The FIGS. 9A.1-9H.4 show various types of multi-band, multi-port antenna feed horns. FIGS. 9A.1 through 9A.5 show various views of a multi-band, multi-port antenna feed horn 900 with a phase adjustment structure that includes a circular reception section 902 feeding an initial phase differential section 904, which in turn feeds a frequency diplexer 906 that separates low-band and high band signals propagating through the diplexer. The frequency diplexer delivers the low-band signal to a first set of waveguide ports 908 *a-b* (one for each linear polarity), and also delivers the high-band signal to a second additive phase differential section 910, which in turn delivers the high-band signal to a second waveguide port 912. The low-band linear polarity pickups are located at the first set of waveguide port 908*a-b* and the high-band linear polarity pickups are located at the second waveguide port 912.

The circular reception section 902 does not impart any differential phase shift on the propagating signal. The initial phase differential section 904 imparts a low-band differential phase shift of 90 degrees and a high-band differential phase shift of 50 degrees. Then the second additive phase differential section 910 imparts an additive 40 degree differential phase shift to the high-band signal. As a result, low-band CP polarization is accomplished at the first set of waveguide port 908*a-b*, whereas high-band CP polarization is accomplished at the second waveguide port 912.

FIGS. 9B.1 through 9B.4 show various views of a multi-band, multi-port antenna feed horn 920 with a phase adjustment structure that includes an elliptical reception section 922 feeding an initial phase differential section 924, which in turn feeds a frequency diplexer 926 that separates low-band and high band signals propagating through the diplexer. The frequency diplexer delivers the low-band signal to a first set of waveguide ports 928 *a-b* (one for each linear polarity), and also delivers the high-band signal to a second phase differential section 930, which in turn delivers the high-band signal to a second waveguide port 932. The low-band linear polarity pickups are located at the first set of waveguide port 928*a-b* and the high-band linear polarity pickups are located at the second waveguide port 932.

The elliptical reception section 922 imparts a low-band differential phase shift of 130 degrees and a high-band differential phase shift of 70 degrees. The initial phase differential section 924 imparts a low-band oppositely sloped subtractive differential phase shift of −40 degrees and a high-band oppositely sloped, subtractive differential phase shift of −25 degrees. Then the second phase differential section 930 imparts an additive 45 degree differential phase shift to the high-band signal. As a result, low-band CP polarization is accomplished at the first set of waveguide port 928*a-b*, whereas high-band CP polarization is accomplished at the second waveguide port 932. In addition, improved x-pol isolation is accomplished for the low-band signal due to the −40 degrees oppositely slopped differential phase characteristic of the initial phase differential section 924. Similarly, improved x-pol isolation is also accomplished for the high-band signal due to the −25 degrees oppositely slopped phase differential characteristic of the initial phase differential section 924.

FIGS. 9C.1 through 9C.3 show an antenna feed horn 940 with a phase adjustment structure that includes an integral elliptical reception and CP polarizer section 942, a frequency diplexer 944, and an additive phase differential section 948. The frequency diplexer 944 separates low-band and high band signals propagating through the diplexer and delivers the low-band signal to a first set of waveguide ports 946*a-b* (one for each linear polarity). The frequency diplexer 944 also delivers the high-band signal to the additive phase differential section 948, which in turn delivers the high-band signal to a second waveguide port 949. The low-band linear polarity pickups are located at the first set of waveguide port 948*a-b* and the high-band linear polarity pickups are located at the second waveguide port 949.

The elliptical reception section 942 imparts a low-band differential phase shift of 90 and a high-band differential phase shift 50 degrees. The additive phase differential section 948 imparts an additive 40 degree differential phase shift to the high-band signal. As a result, low-band CP polarization is accomplished at the first set of waveguide port 946*a-b*, whereas high-band CP polarization is accomplished at the second waveguide port 949.

FIGS. 9D.1 through 9D.4 show various views of a multi-band, multi-port antenna feed horn 950 with a phase adjustment structure that includes an elliptical transition section 952, an initial additive phase differential section 954, a frequency diplexer 956, and a second additive phase differential section 958. The frequency diplexer 956 separates low-band and high band signals propagating through the diplexer. The frequency diplexer delivers the low-band signal to a first set of waveguide ports 957 *a-b* (one for each linear polarity), and also delivers the high-band signal to the second additive phase differential section 958, which in turn delivers the high-band signal to a second waveguide port 959. The low-band linear polarity pickups are located at the first set of waveguide port 957*a-b* and the high-band linear polarity pickups are located at the second waveguide port 959.

The elliptical reception section 952 imparts a low-band differential phase shift of 60 degrees and a high-band differential phase shift of 35 degrees. The initial phase differential section 954 imparts a low-band additive differential phase shift of 30 degrees and a high-band differential phase shift of 20 degrees. Then the second additive phase differential section 958 imparts an additive 35 degree differential phase shift to the high-band signal. As a result, low-band CP polarization is accomplished at the first set of waveguide port 957*a-b*, whereas high-band CP polarization is accomplished at the second waveguide port 959.

FIGS. 9E.1 through 9E.5 show various views of a multi-band, multi-port antenna feed horn 960 with a phase adjustment section including a circular reception section 961 feeding an initial phase differential section 962, which in turn feeds a frequency diplexer 964 that separates low-band and high band signals propagating through the diplexer. The frequency diplexer delivers the low-band signal to a first set of waveguide ports 966*a-b* (one for each linear polarity), and also delivers the high-band signal to an oppositely sloped phase differential section 968, which in turn delivers the high-band signal to a second waveguide port 969. The low-band linear polarity pickups are located at the first set of waveguide port 966*a-b* and the high-band linear polarity pickups are located at the second waveguide port 969.

The circular reception section 961 does not impart any differential phase shift on the propagating signal. The initial phase differential section 962 imparts a low-band differential phase shift of 90 degrees and a high-band differential phase shift of 50 degrees. Then the oppositely sloped differential section 968 imparts a −140 degree differential phase shift to the high-band signal. As a result, low-band CP polarization is accomplished at the first set of waveguide port 966*a-b*, whereas high-band CP polarization is accomplished at the second waveguide port 969. In addition, improved x-pol isolation is accomplished for the high-band signal due to the −140 degrees oppositely slopped phase differential characteristic of the phase differential section 968.

FIGS. 9F.1 through 9F.4 show various views of a multi-band, multi-port antenna feed horn 970 with a phase adjustment structure that includes an elliptical transition section 971, an initial oppositely sloped phase differential section 972, a frequency diplexer 974, and a second oppositely sloped phase differential section 978. The frequency diplexer 974 separates low-band and high band signals propagating through the diplexer. The frequency diplexer delivers the low-band signal to a first set of waveguide ports 976 *a-b* (one for each linear polarity), and also delivers the high-band signal to the second additive phase differential section 978, which in turn delivers the high-band signal to a second waveguide port 979. The low-band linear polarity pickups are located at the first set of waveguide port 976*a-b* and the high-band linear polarity pickups are located at the second waveguide port 979.

The elliptical reception section 971 imparts a low-band differential phase shift of 130 degrees and a high-band differential phase shift of 70 degrees. The initial phase differential section 972 imparts a low-band differential phase shift of −40 degrees and a high-band differential phase shift of −25 degrees. Then the second phase differential section 978 imparts an oppositely sloped −135 degree differential phase shift to the high-band signal. As a result, low-band CP polarization is accomplished at the first set of waveguide port 976*a-b*, whereas high-band CP polarization is accomplished at the second waveguide port 979. In addition, improved x-pol isolation is accomplished for the low-band signal due to the −40 degrees oppositely slopped phase differential characteristic of the initial phase differential section 972. Similarly, improved x-pol isolation is also accomplished for the high-band signal due to the −25 degrees oppositely slopped phase differential characteristic of the first phase differential section 972 and the −135 degrees oppositely slopped differential phase characteristic of the second phase differential section 978.

FIGS. 9G.1 through 9G.4 show various views of a multi-band, multi-port antenna feed horn 980 with a phase adjustment structure that includes an integral elliptical reception and CP polarizer 982, a frequency diplexer 984, and an oppositely sloped phase differential section 988. The frequency diplexer 984 separates low-band and high band signals propagating through the diplexer and delivers the low-band signal to a first set of waveguide ports 986*a-b* (one for each linear polarity). The frequency diplexer 984 also delivers the high-band signal to the oppositely sloped phase differential section 988, which in turn delivers the high-band signal to the second waveguide port 989. The low-band linear polarity pickups are located at the first set of waveguide port 986*a-b* and the high-band linear polarity pickups are located at the second waveguide port 989.

The elliptical reception section 982 imparts a low-band differential phase shift of 90 degrees and a high-band differential phase shift 50 degrees. The additive phase differential section 988 imparts an oppositely sloped −160 degree differential phase shift to the high-band signal. As a result, low-band CP polarization is accomplished at the first set of waveguide port 986*a-b*, whereas high-band CP polarization is accomplished at the second waveguide port 989. In addition, improved x-pol isolation is accomplished for the high-band signal due to the −160 degrees oppositely slopped phase differential characteristic of the oppositely slopped phase differential section 988.

FIGS. 9H.1 through 9H.4 show various views of a multi-band, multi-port antenna feed horn 990 with a phase adjustment structure that includes an elliptical transition section 991, an initial additive phase differential section 992, a frequency diplexer 994, and an oppositely sloped phase differential section 998. The frequency diplexer 994 separates low-band and high band signals propagating through the diplexer. The frequency diplexer delivers the low-band signal to a first set of waveguide ports 996 *a-b* (one for each linear polarity), and also delivers the high-band signal to the oppositely sloped phase differential section 998, which in turn delivers the high-band signal to a second waveguide port 999. The low-band linear polarity pickups are located at the first set of waveguide port 996*a-b* and the high-band linear polarity pickups are located at the second waveguide port 999.

The elliptical reception section 991 imparts a low-band differential phase shift of 60 degrees and a high-band differential phase shift of 35 degrees. The initial phase differential section 992 imparts a low-band additive differential phase shift of 30 degrees and a high-band additive differential phase shift of 20 degrees. Then the oppositely sloped phase differential section 998 imparts an oppositely sloped −145 degree differential phase shift to the high-band signal. As a result, low-band CP polarization is accomplished at the first set of waveguide port 996*a-b*, whereas high-band CP polarization is accomplished at the second waveguide port 999. In addition, improved x-pol isolation is accomplished for the high-band signal due to the −145 degrees oppositely slopped phase differential characteristic of the phase differential section 998.

Figure 10A:
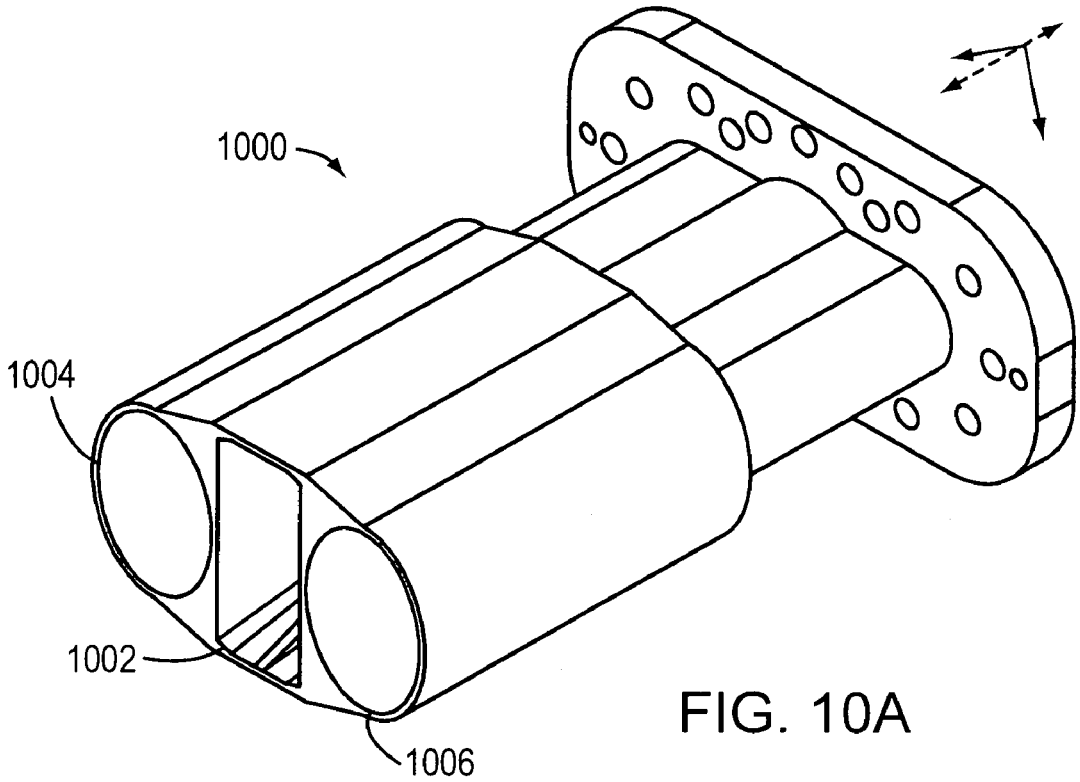
FIG. 10A shows a perspective of a three-horn antenna feed block.
Figure 10B:
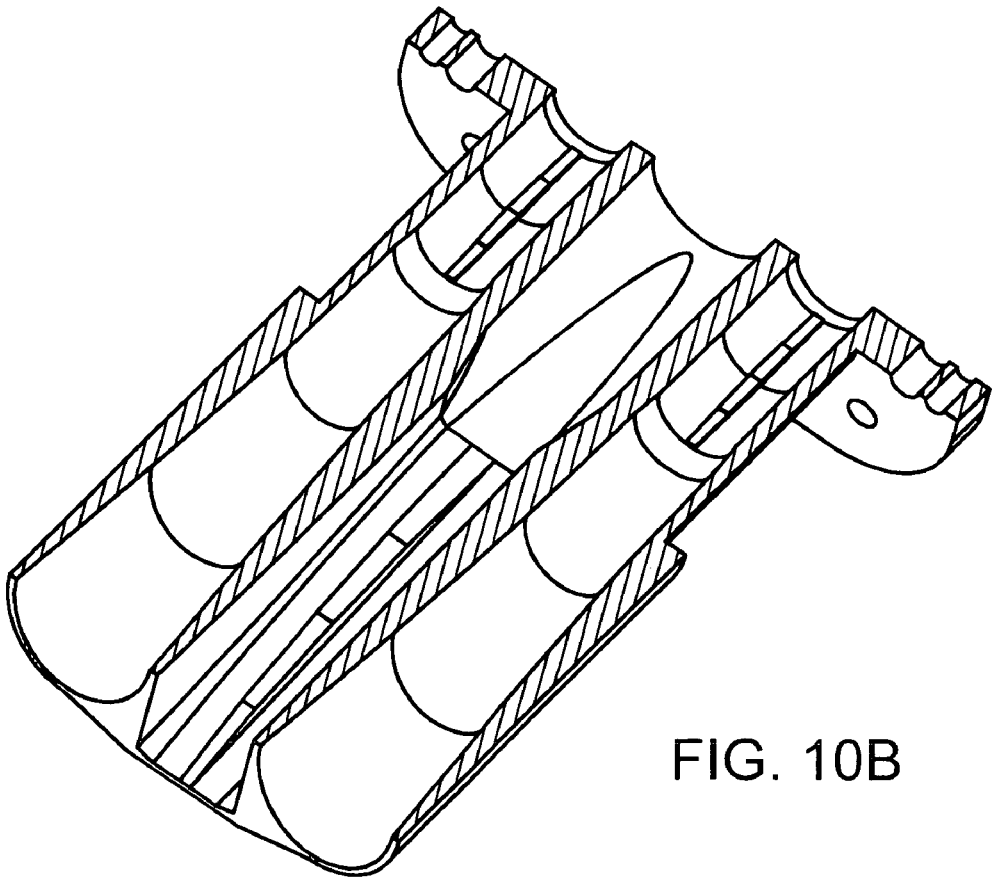
FIG. 10B shows a cross-section of the perspective view of a three-horn antenna feed block of FIG. 10A.

FIGS. 10A-B show a three-horn antenna feed block 1000 including a substantially rectangular center feed horn 1002 located between a first elliptical feed horn 1002 and a second elliptical feed horn 1004. The feed block 1000 is an integral structure that includes the feed horns 1002, 1003 and 1004 along with a composite LNB to form a three-horn integral LNBF within a single casting. Any of the feed horns described in this specification, as potentially modified to a substantially rectangular feed horn profile for the center horn (or to any other profile for any of the horns) may be used as alternative embodiments. In a particular embodiment, the center feed horn 1002 receives a beam in the frequency band of 12.7-12.7 GHz (Ku BSS band) from a satellite located at 101 degrees west longitude. The left feed horn 1004 receives a beam in the frequency band of 18.3-18.8 and 19.7-20.2 GHz (Ka band) from a satellite located at 102.8 degrees west longitude. The right feed horn 1006 receives a beam in the frequency band of 18.3-18.8 and 19.7-20.2 GHz (Ka band) from a satellite located at 99.2 degrees west longitude.

Figure 11A:
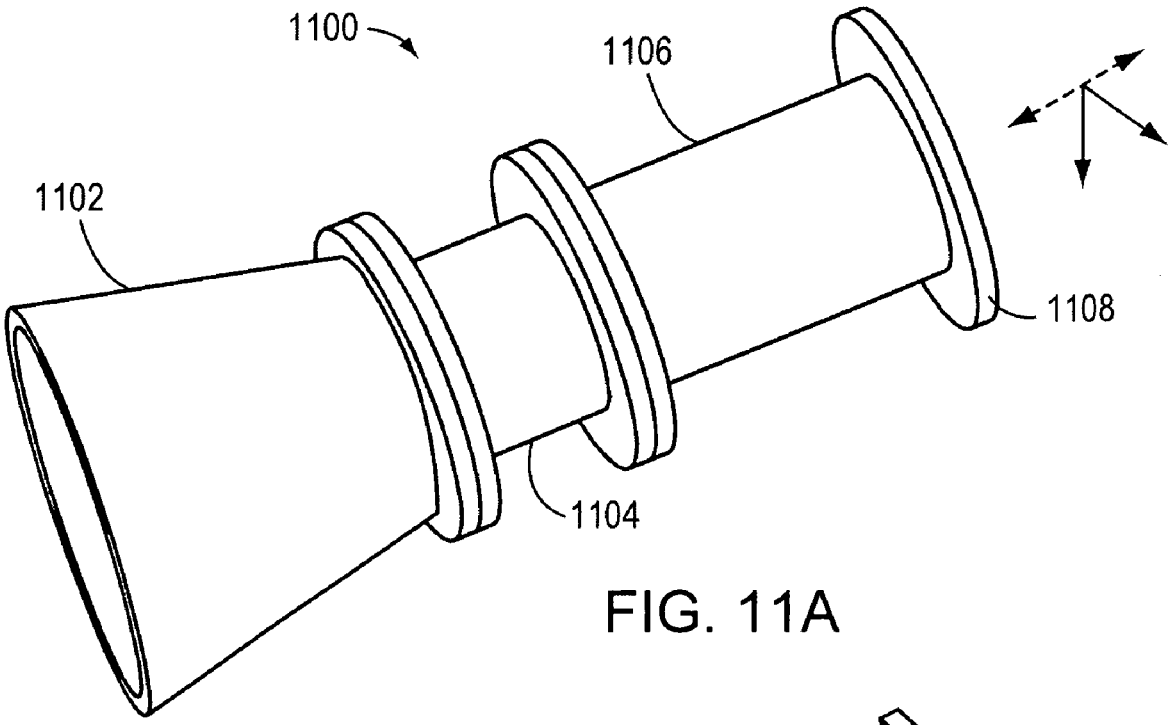
FIGS. 11A-B shows a cross-section of the perspective view of an antenna horn with an elliptical transition section, a CP polarizer, and phase compensation section.
Figure 11B:
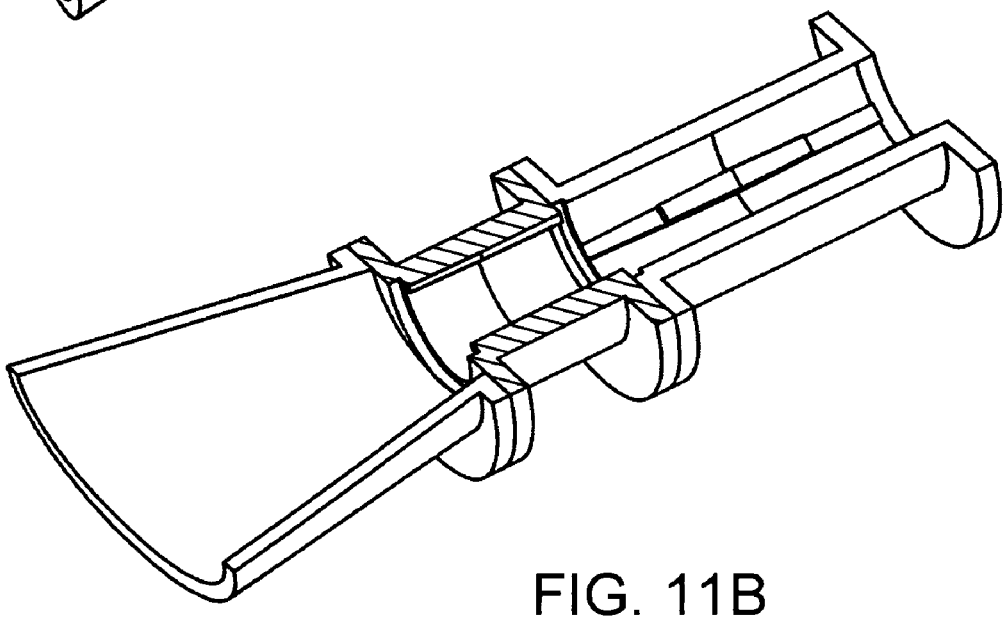
Figure 11C:
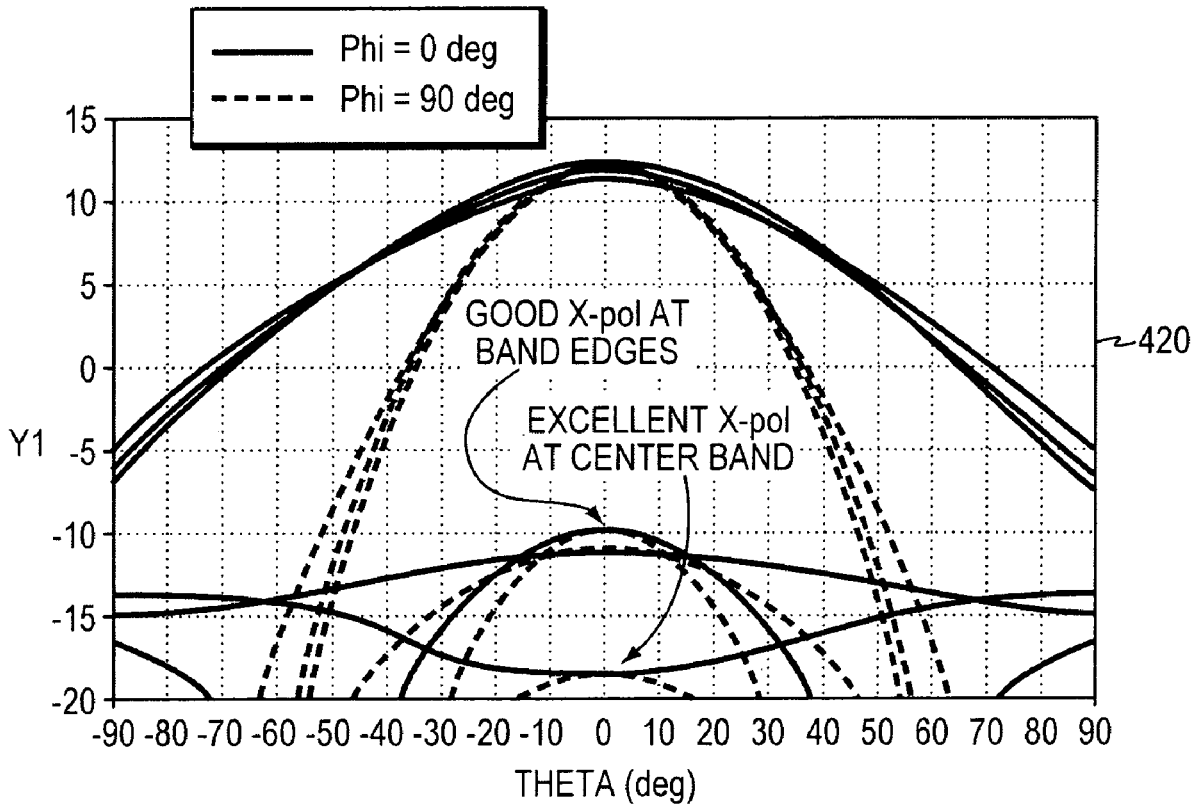
FIG. 11C is a graphical illustration of the circular polarity cross-polarization isolation characteristic of the antenna horn of FIGS. 11A-B.

FIGS. 11A-B show an antenna horn 1100 with a phase adjustment structure that includes an elliptical transition section 1102, a phase compensation section 1104, and a CP polarizer 1106, which delivers the propagating signal to a waveguide port 1108 where the linear polarity pickups are located. The elliptical reception section 1102 imparts a differential phase shift of 35 degrees, the phase compensation section 1104 imparts a differential phase shift of −35 degrees, and the CP polarizer 1106 imparts a differential phase shift of 90 degrees. Thus, CP polarization is accomplished at waveguide port 1108 whereas high-band CP polarization is accomplished at the second waveguide port 999. FIG. 11C is a graphical illustration 420 of the circular polarity cross-polarization isolation characteristic of the antenna horn 1100 shown in FIGS. 11A-C. Comparing this result to the graphical illustration 120 shown in FIG. 1D for the prior art antenna horn 100 shown in FIGS. 1A-B illustrates the greatly improved x-p61 isolation characteristic achieved by the horn 1100.

Figure 12A:
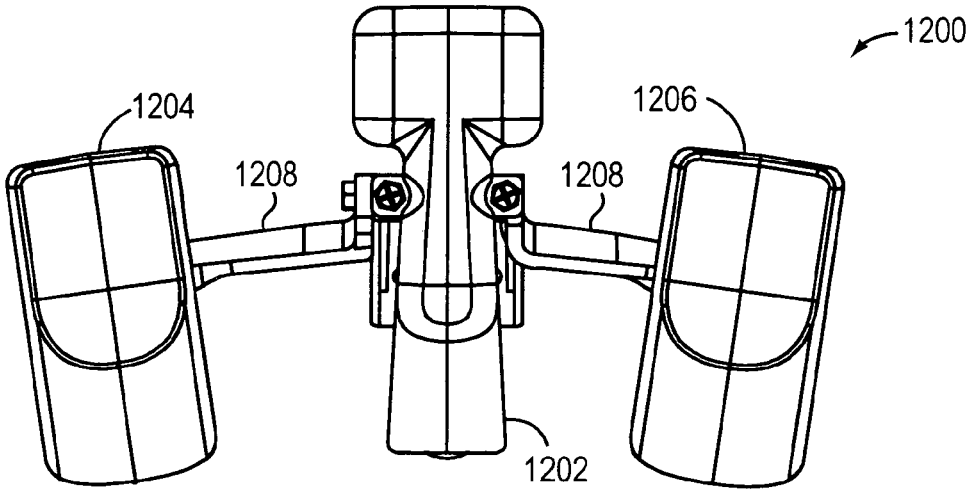
FIG. 12A is a top view of a three-horn antenna feed block with an elliptical feed horn located between two circular feed horns.
Figure 12B:
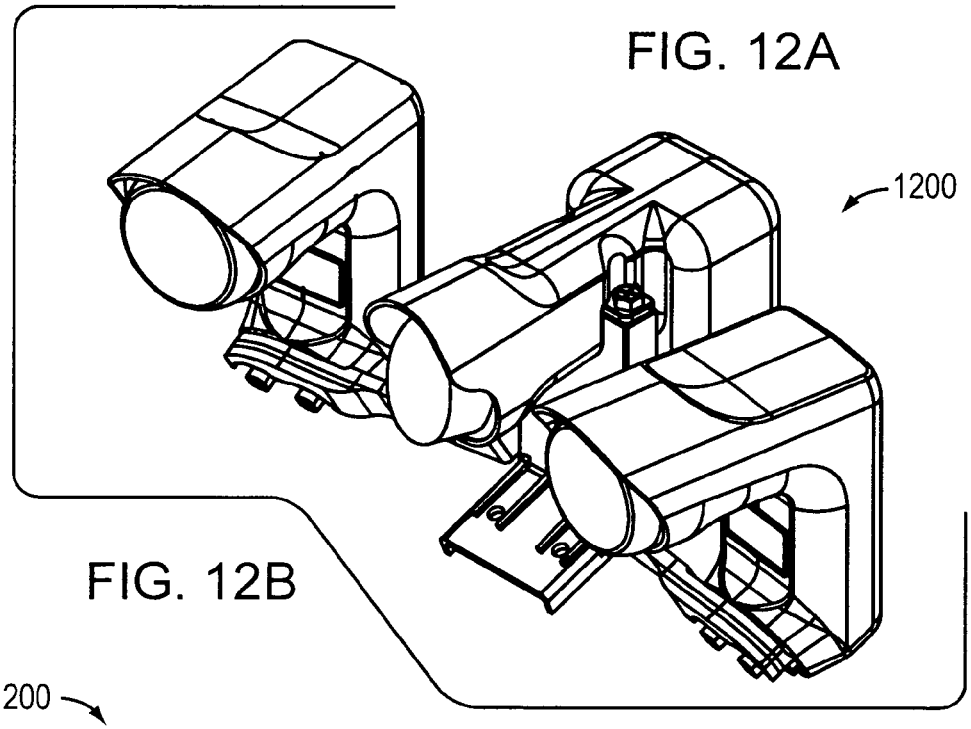
FIG. 12B is a perspective view of the three-horn antenna feed block of FIG. 12A.
Figure 12C:
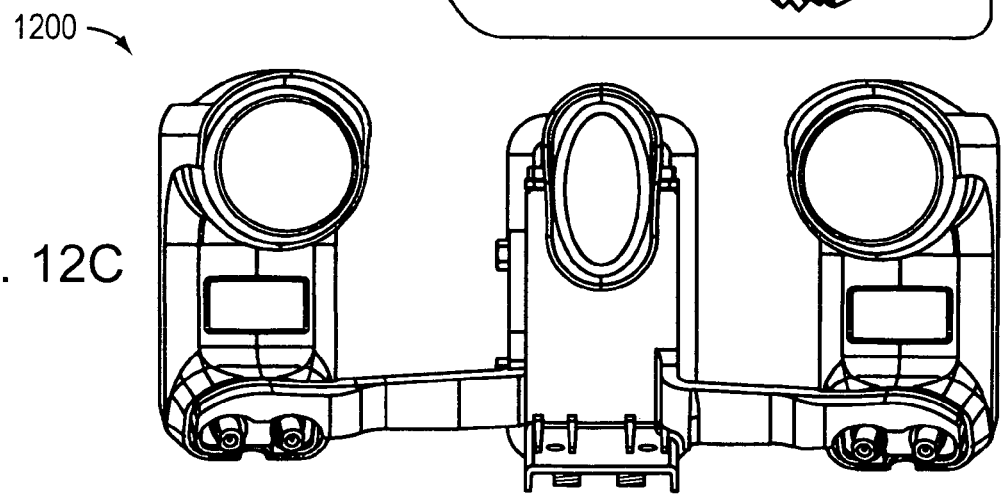
FIG. 12C is a front view of the three-horn antenna feed block of FIG. 12A.

FIGS. 12A-C show a three-horn antenna feed structure 1200 with an elliptical feed horn 1202 located between two circular feed horns 1204 and 1206. In this embodiment, each antenna horn feed block 1002, 1204 and 1206 is an integral structure that includes an LNB to form a single-horn integral LNBF within a single casting. All three feed horns are mounted on a common feed support bracket 1208. Any of the feed horns described in this specification, as potentially modified to a substantially to any other profile for any of the horns, may be used as alternative embodiments. In a particular embodiment, the center feed horn 1002 receives signals from two satellites that are located close together (from the perspective of the horn). The first satellite transmits in the frequency band of 12.7-12.7 GHz (Ku BSS band) from a location at 119 degrees west longitude, and the second satellite transmits in the frequency band of 11.7-12.2 GHz (Ku BSS band) from a location at 118.7 degrees west longitude to produce an 11.7 to 12.2 CP broadband signal. Accordingly, the broad band antenna feed horn 600 described with reference to FIGS. 6A-C is suitable for this application. The left feed horn 1004 receives a beam in the frequency band of 12.2-12.7 GHz (Ku BSS band) from a satellite located at 129 degrees west longitude. The right feed horn 1006 receives a beam in the frequency band of 112.2-12.7 GHz (Ku BSS band) from a satellite located at 110 degrees west longitude.

Additional description of the advantages, functions and configurations of the embodiments of the invention with reference to certain prior art configurations is set for the below.

Current Compromised Approach #1 (CCA#1):

FIGS. 1A-D illustrate a first current (prior art) compromised approach (CCA#1). Many elliptical reflector systems simply use circular beam feeds with conventional CP polarizers in order to preserve good circular polarity cross polarization isolation. This approach is easy to implement but results in significant compromise (degradations) in efficiency, gain noise temperature, beam width, and side lobe performance of the reflector system, because the circular beam feeds do not properly illuminate the elliptical reflector.

As shown in FIG. 2, the illumination level along the short axis of the reflector is to high resulting in large amounts of wasted spillover energy that degrades gain, efficiency, and noise temperature, and/or the illumination level along the long axis of the reflector is to low resulting in degraded taper efficiency and gain. In addition, this improper illumination makes it very difficult to achieve desired beam width and side lobe performance. The high illumination along the short axis of the antenna degrades (raises) side lobes. The low illumination along the long axis of the antenna degrades (widens) beam widths. In addition, for multi-beam applications where a single reflector is required to receive from and/or transmit to multiple sources (satellites) that are closely spaced, circular feeds are often too wide to allow the close physical spacing required between the feeds.

Several of embodiments of the invention (i.e., all embodiments except those shown on FIGS. 9A1-A5 and 9E1-E5) solve the fundamental performance and implementation limitations of CCA#1 through the use of elliptical beam feed horns to optimize the elliptical reflector performance (efficiency, gain, noise temperature, side lobes, and beam width), while achieving good or excellent circular polarity performance including acceptable cross polarization isolation. Using an elliptical beam feed provides proper illumination of the entire elliptical reflector (along alls axis) reducing spillover while maintaining good taper efficiency and gives the designer the freedom to illuminate the elliptical reflector in a manor to best optimize performance for a particular application and customer requirements. For some applications, in fact, this elliptical beam feed could be used on circular reflectors as a means of improving (narrowing) beam widths while maintaining reasonable efficiency, gain, and noise temperature. Specifically, an elliptical illumination on circular reflector can increase the illumination only in the direction (typically along the satellite belt) needed to improve (narrow) the beam width in that direction while maintaining relatively low illumination in the orthogonal direction (perpendicular to the satellite belt), which helps maintain reasonable gain and noise temperature performance. In addition, these elliptical feeds can be made considerably narrower than circular feeds which accommodates the closely spaced feed requirements for many multi-beam single reflector applications.

Figure 1D:
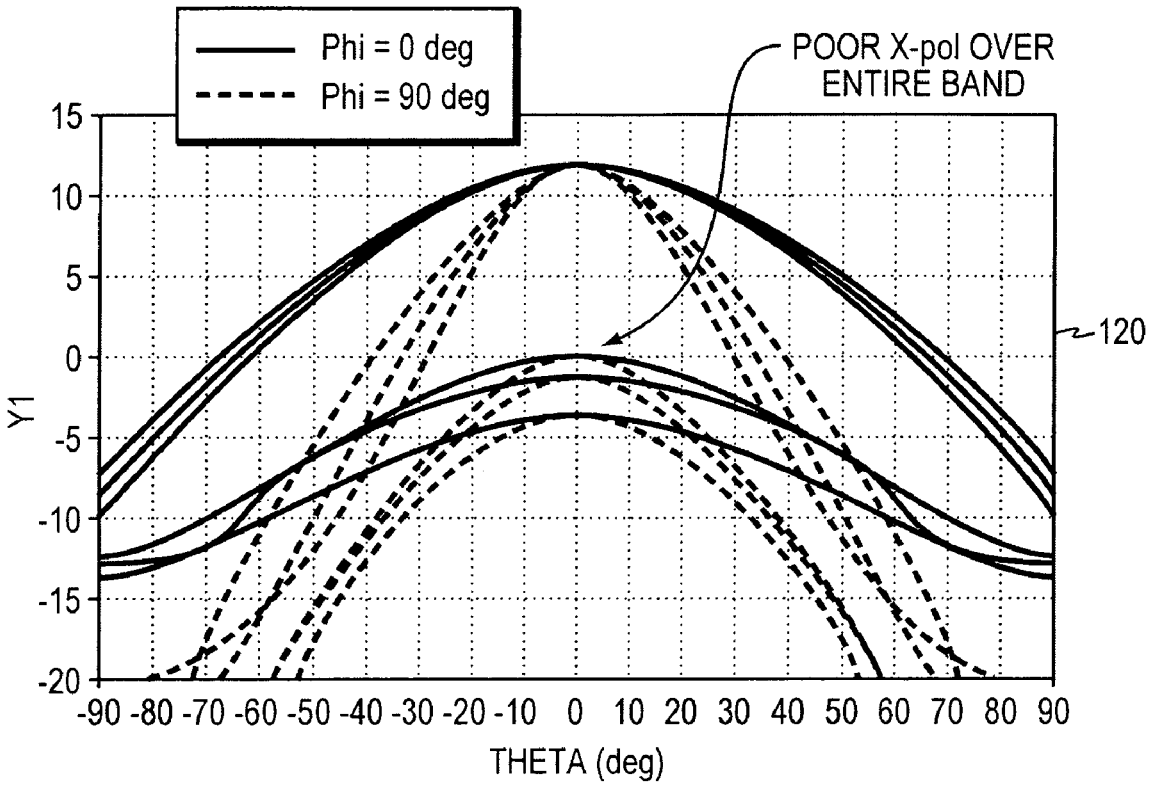
FIG. 1D PRIOR ART
FIG. 1D is a graphical illustration of the circular polarity cross-polarization isolation characteristic of the antenna horn of FIG. 1*a*.

Current Compromised Approach #2 (CCA#2):

There have been other prior art approaches that use elliptical (or oblong) beam horns on elliptical (or oblong) reflectors. However, these prior art configurations result in poor x-pol isolation when a CP polarizer is simply attached to the elliptical feed horn section, as shown in FIGS. 1A-D. Consider a perfect circular polarity beam impinging on an elliptically shaped receiving horn. Recall that circular polarity can be expressed as the vector sum of two orthogonal linear components that are 90 degrees out of phase. For simplicity, these orthogonal linear components may be referred to as H (horizontal) and V (vertical), where H is aligned with (parallel to) the x-axis and V is aligned with the y-axis. As the circular polarity enters the horn, the elliptical shape of the interior surface of the horn causes the H and V components to travel at different phase velocities through the horn so the H and V components are no longer 90 degrees out of phase when they reach the end of the horn (at the start of the polarizer section). The H and V components might now be, for example, either 60 or 120 degrees out of phase depending upon the CP polarizer orientation and if the initial CP was RHCP or LHCP. So elliptical polarity now exists at the start of the polarizer section. Simply using a circular polarity polarizer will result in poor cross polarization isolation as shown in FIG. 1D because conventional circular polarity polarizers are designed to convert circular polarity (not elliptical polarity) to linear polarity by delaying one linear component 90 degrees relative to the other linear component.

Furthermore, as show in FIGS. 1A-C, many applications orient the CP polarizer at 45 degrees so that the linear probes or wave-guide slots are vertically and/or horizontally oriented in the LNB or OMT that is connected to the polarizer. This is convenient for mechanical packaging. However, with an elliptical horn this presents a problem because the horn has already introduced a phase differential in the vectors aligned with the wide or narrow walls of the feed (not in the vectors oriented at 45 degrees as the CP polarizer is oriented). So the total phase differential from the horn and CP polarizer is more than the desired 90 degrees and not aligned with the LNB or OMT that is connected to the polarizer. Both the improper amount and improper alignment of the phase differentials will seriously limit CP cross polarization performance.

Advantages of Certain Embodiments of this Invention Over CCA#2:

All of the embodiments of the present invention overcome the fundamental performance shortcomings of CCA#2 caused by improper orientation and improper phase differential imparted by the horn and CP polarizer.

Current Compromised Approach #3 (CCA#3):

A third compromised approach referred to as CCA#3 is described in U.S. Pat. No. 6,570,542 includes a septum dividing an elliptical antenna horn. The embodiments of the present invention include an undivided elliptical antenna feed horn section to improve over the divided elliptical horn section of CCA#3.

Advantages of Certain Embodiments of this Invention Over CCA#3:

In particular, the antenna feed horn 400 shown in FIGS. 4A-B includes a phase adjustment structure that includes only an elliptical beam horn with integral CP polarizer functionality. To enable this embodiment, the inventor recognized that by carefully selecting the height, width, length, flare angle and internal profile of the interior surface of the horn, an elliptical antenna feed horn can be designed to receive circular polarity and provide good cross polarization isolation without the need for a separate polarizer section or a divided elliptical feed horn section, such as one including a septum that spans across elliptical horn section. This is monumental step forward because it greatly reduces the size and complexity of the elliptical horn polarizer. This is because the elliptical horn section and polarizer are now integrally formed into the same structure, which eliminates unnecessary components and thereby makes this embodiment easier and less costly to manufacture via die-casting, machining or other means. In addition, the internal dimensions of this embodiment can have angular drafts that are all in the same direction, meaning that the internal cross section gets larger from the input waveguide out towards the horn opening or aperture. This is very convenient for integrating the horn into a die-cast LNBF, OMT, diplexer or other device.

The horn transition section as shown in FIGS. 4A-B transitions smoothly, and in this particular example linearly, from an elliptical shape at the input aperture to a circular waveguide at the output aperture. For all embodiments of this invention, however, the horn transition section could be configured non-linearly and/or in multiple sections that change (transition) at various rates and, in fact, can include abrupt steps as well as a means to control performance and length of the horn. The inventor also recognized that the dimensions of the sections and step can be carefully chosen so that unwanted modes can be limited in order to maintain excellent illumination, match, and CP cross polarization performance.

The different height and width of an elliptical horn (major and minor axis) introduces a phase differential between the 2 orthogonal linear components as they propagate through the horn. The inventor recognized that by choosing the horn transition section dimensions (H, W and length) appropriately the phase differential "X" can be made almost exactly 90 degrees or any odd integer multiple of 90 degrees (e.g., −630 degrees, −450 degrees, −270 degrees, −90 degrees, 90 degrees, 270 degrees, 450 degrees, 630 degrees) at a given frequency. So near center band the nominal phase differential "X" introduced by the horn transition section can simply be described by X=90 degrees*n where n is an odd integer. This results in excellent power conversion from CP to LP and excellent cross polarization isolation performance at a single frequency and good cross polarization isolation over a modest bandwidth.

The antenna feed horn 400 shown in FIGS. 4A-B works best when the linear polarity probes, slots etc. are oriented at 45 deg. However, the principles of the invention are also applicable to any alternative embodiment constructed by orienting the probes/slots at other angles.

The antenna feed horn 600 described with reference to FIGS. 6A-B, is a broadband high performance elliptical beam circular polarity design that employs an elliptical beam horn deliberately designed to work in conjunction with an additional opposite slope phase differential section to greatly improve performance over very broad frequency bands as shown in FIG. 6C. To enable this embodiment, the inventor recognized that the phase differential introduced by most circular polarizers and the elliptical horn 400 (FIGS. 4A-B) are not a constant over the desired bandwidth. It is generally sloped versus frequency as shown in FIG. 7. So for the elliptical horn of embodiment 400, and for most circular polarity polarizers, the desired 90 degree total phase differential needed for complete CP conversion only occurs at a single frequency. This slope in phase differential versus frequency fundamentally limits the cross polarization performance over a wide bandwidth.

For this embodiment, the inventor also recognized that an elliptical aperture receiving device can include a phase adjustment structure that includes an elliptical transition section and an oppositely sloped phase differential section that introduces a phase differential in the opposite direction of the elliptical transition section. Specifically, if one of these components (transition section or opposite slope phase differential section) introduces a phase lag between initially orthogonal component of the incident beam, then the other component can be designed to introduce a phase lead between those beam components. These sections are also cooperatively designed so that the total differential phase shift through the phase adjustment structure is 90 degrees or an odd integer multiple at a desired nominal (center band) frequency. The combination of leading and lagging phase differential components, imparting their opposing differential phase slope effects, allows the combined sections of the antenna horn to introduce a total phase differential between the beam components near 90 degrees over a wide frequency band. In other words, the resulting cross polarization isolation is better and more constant over a wider desired frequency band.

In this particular example, the phase adjustment structure of the horn includes a transition section that introduces a nominal phase differential "X" (X=130 degrees) and an opposite slope phase differential section positioned after the transition section that introduces an opposite phase differential "Y" (Y=−40 degrees) at a desired nominal frequency. Thus, the resulting total phase differential through the horn transition section and opposite slope phase differential section is the desired 90 degrees for CP polarization at the desired nominal frequency. This may be accomplished with any combination of oppositely sloped differential phase compensation (130 degrees−40 degrees in this example) or an odd integer multiple of 90 degrees (e.g., −630 degrees, −450 degrees, −270 degrees, −90 degrees, 90 degrees, 270 degrees, 450 degrees, 630 degrees etc.). In other words, near center band the phase differentials introduced by the 2 sections can be described by:

$$90*n=X+Y, \text{ where "n" is an odd integer}$$

In this equation, X is the nominal center band phase differential between orthogonal linear components introduced by of the horn transition section and Y is the nominal center band phase differential introduced by the opposite phase slope section, wherein Y and X have opposite slope (i.e., one is positive and the other is negative).

Importantly, the phase differential versus frequency response for the opposite slope phase differential section slopes in an opposing direction from the phase differential versus frequency response of horn transition section. As a result, the total (sum of) phase differential versus frequency of the phase adjustment structure is relatively flat in that it maintains a values close to 90 degrees or an odd integer multiple of 90 degrees over a much greater band width. As shown in FIG. 8, for example, at 11.2 GHz the phase differential is 93 degrees (i.e., 149 degrees−56 degrees) at 12.2 GHz it is 90 degrees (i.e., 130 degrees−40 degrees), and at 13.2 GHz it is 93 degrees (i.e., 114 degrees−24 degrees). This results in excellent CP conversion and excellent CP cross polarization performance over a wide bandwidth as shown in FIG. 6C.

As another example the elliptical horn transition section could introduce a nominal 70 degrees of phase differential and the opposite phase slope section could introduce a nominal −160 degrees resulting in a nominal −90 degrees total phase differential. This also means the elliptical horn transition section could, for example, introduce a nominal 470 degrees of phase differential and the opposite phase slope section could introduce a nominal −200 degrees resulting in a nominal 270 degrees total phase differential.

This embodiment 600 described with reference to FIGS. 6A-C is typically slightly longer than the first embodiment 400 described with reference to FIGS. 4A-B, but is still relatively easy and cost effective to manufacture (die-cast, machine, etc.) and integrate into an LNBF die cast housing. The embodiment 600 works best if the opposite slope phase differential section is aligned vertically with the ridges aligned with the long axis of the elliptical horn aperture and the linear polarity probes, slots etc. are oriented at 45 deg. However, this patent should be construed to cover any alternative embodiment designed by orienting the polarizer and or probes/slots at other angles. The principles of the invention are also applicable to any alternative embodiment that breaks up the phase compensated polarizer function/section up further into multiple sections.

The embodiment 500 shown FIGS. 5A-C is an elliptical beam circular polarity design that employs an elliptical beam horn with an additive phase differential section to achieve CP polarization conversion over modest bandwidths. For this embodiment, the inventor recognized that the phase differential "X" introduced between orthogonal linear components by the elliptical horn is often something other than 90 degrees (X=35 degrees for example) and that an additive phase differential section can be added to provide the additional phase differential Y (Y=55 degrees in this example) to obtain a total phase differential of 90 degrees or an odd integer multiple of 90 degrees ( . . . −630 degrees, −450 degrees, −270 degrees, −90 degrees, 90 degrees, 270 degrees, 450 degrees, 630 degrees . . . ) near center band. The nominal phase differentials from the horn transition section and the additive phase differential section are indeed additive or in the same direction (if one introduces a phase lag between distinct orthogonal linear components the other also introduces a phase lag between those same components). So near center band the phase differentials introduced by the 2 sections can be described by:

$$90*n=X+Y, \text{ where "n" is an odd integer}$$

In this equation, X is the nominal center band phase differential between orthogonal linear components introduced by of the horn transition section and Y is the nominal center band phase differential introduced by the additive phase differential section, and Y must have the same sign as X.

Typically, the phase differential versus frequency from the horn transition section and the additive phase differential section are sloped in the same direction so the resulting total (sum) is sloped and the phase differential is not 90 degrees at the band edges. So this embodiment provides excellent CP conversion and CP cross polarization performance near center band and good performance at band edges. Although this embodiment 500 (FIGS. 5A-C) is not as broadband as embodiment 600 (FIGS. 6A-B) it can be used as an alternative and specifically for designs where there are limits on physical dimensions (length in particular) and bandwidth requirements are modest.

The embodiment illustrated by the antenna feed horn 500 described with reference to FIGS. 5A-C works best if the additive phase differential section is aligned horizontally with the ridges aligned with the short axis of the elliptical horn aperture as shown in FIGS. 5A-C, and the linear polarity probes, slots etc. are oriented at 45 degrees. However, the principles of the invention are also applicable to any alternative embodiment constructed by orienting the polarizer and or probes/slots at other angles. The principles of the invention are also applicable to any alternative embodiment constructed by breaking up the phase compensated polarizer function/section further into multiple sections.

The multi-beam embodiments shown FIGS. 9A.1-9H.4 employ multiple phase differential sections to achieve multi-band circular polarity performance in elliptical (or oblong), or circular beam receiving and/or transmitting devices. Many applications are requiring multiple frequency bands to be received and/or transmitted through the same feed horn on a reflector antenna system. For example, the receive band might be at 19.7-20.2 GHz while the transmit band might be at 29.5-30 GHz. Circular polarity polarizers that perform well over both bands are difficult to design, and if an elliptical illumination is also required of the horn the phase differential introduced by the horn (discussed above) adds to the difficulties. The methods used in the antenna feed horn embodiments 400 (FIGS. 4A-B), 500 (FIGS. 5A-C) and 600 (FIGS. 6A-B) can be employed to improve circular polarity performance with the elliptical feed, but for applications with multiple bands separated widely in frequency, even using the antenna feed horn embodiment 600 (FIGS. 6A-B) alone may not provide adequate performance.

To enable these embodiments, the inventor recognized that multiple stages of phase differential sections in combination with diplexing sections to extract and isolate bands, can be used in such cases. For simplicity the case of only 2 bands widely separated in frequency will be described here as an example (however the technique could be used for multiple bands). The inventor also recognized that phase differential sections or horn transition sections introduce more phase differential at lower frequencies than at higher frequencies and understood that this could be exploited to achieve excellent CP performance over multiple bands.

Specifically, for antenna feed horn 900 described with reference to FIG. 9*a*, the inventor recognized that the horn transition section (HTS) and initial phase differential section (IPDS) can be used to introduced the desired nominal 90 phase differential at the lowest frequency band (12.2-12.7 GHz for example), but not at the higher frequency band (only 50 degrees nominally at 18.3-20.2 GHz for example) so the lower band (LB) has been completely converted from CP to LP (either single or dual polarities) and can be separated from the center wave-guide via a typical OMT or Co-polarity diplexer (or other means), allowing the upper band to pass through. The upper freq band continues on through another second phase differential section (SPDS) that introduces the remaining additive phase differential (40 degrees nominally for this example) needed for high band so that the total phase differential is nominally 90 (50+40) at the center of the upper frequency band. For this case the phase differential introduced at high band by the SPDS (40 deg) is additive and the ridges in the SPDS are aligned with the ridges in the IPDS (unless the elliptical horn transition section introduces more phase differential than the IPDS). FIGS. 9*b,c,d* illustrates additional implementations of this concept for Elliptical Horns with the understanding that the elliptical horn transition section introduces part of the phase differential needed at both the high and low bands.

As another example, the antenna feed horn 920 described with reference to FIG. 9*b* includes an elliptical transition section that introduces a nominal 130 degrees of low band phase differential and 70 degrees of high band phase differential. The IPDS introduces a nominal −40 degrees of low band opposite slop phase differential and −25 degrees of high band phase differential. So at the input to the diplexer 90 degrees (=130 degrees−40 degrees) of phase differential has been introduced at low band providing excellent low band CP to LP conversion performance so that the diplexer can extract the resulting low band linear polarity signals into the side ports and pass the high band signals that only have 45 degrees (=70 degrees−25 degrees) of phase differential. The SPDS then introduces a nominal 45 degrees of additive high band phase differential needed so that the total high band phase differential of 90 degrees (=70 degrees−25 degrees+45 degrees) results and good CP to LP conversion occurs at high band as well For the antenna feed horn 940 described with reference to FIG. 9*c*, the elliptical Horn introduces a nominal 90 degrees of low band phase differential and 50 degrees of high band phase differential. There is no need for an IPDS in this case because the elliptical horn introduced the entire nominal 90 degrees of low band phase differential providing good low band CP to LP conversion performance so that the diplexer can extract the resulting low band linear polarity signals into the side ports and pass the high band signals that only have 50 degrees of phase differential. The SPDS then introduces a nominal 40 degrees of additive high band phase differential needed so that the total high band phase differential of 90 degrees (=50 degrees−40 degrees) results and good CP to LP conversion occurs at high band as well.

For the antenna feed horn 950 described with reference to FIG. 9*d*, the elliptical Horn introduces a nominal 60 degrees of low band phase differential and 35 degrees of high band phase differential. The IPDS introduces a nominal 30 degrees of low band additive phase differential and 20 degrees of high band phase differential. So at the input to the diplexer 90 degrees (=60 degrees+30 degrees) of phase differential has been introduced at low band providing good low band CP to LP conversion performance so that the diplexer can extract the resulting low band linear polarity signals into the side ports and pass the high band signals that only have 55 degrees (=35 degrees+20 degrees) of phase differential. The SPDS then introduces an nominal 35 degrees of additive high band phase differential needed so that the total high band phase differential of 90 degrees (=35 degrees+20 degrees+35 degrees) results and good CP to LP conversion occurs at high band as well The antenna feed horn 960 described with reference to FIG. 9*e* provides an example where the SPDS introduces a nominal −140 degrees and is oppositely sloped from the phase differential introduced by the HTS and IPDS in the upper frequency band. As in the antenna feed horn 600, this opposite slope results in a total phase differential of very close to −90 degrees across the entire upper band (for example: −92=60-152 at the bottom of the upper band, −90=50-140 at center of the upper band, −88=40-128 at the top of the upper band) and improved CP cross polarization isolation performance over the entire upper band. For this case ridges in the SPDS or IPDS will be perpendicular to the ridges of the IPDS (unless the elliptical horn transition section introduces more phase differential than the IPDS). FIGS. 9*f, g, h* illustrates additional implementations of this concept for Elliptical Horns with the understanding that the elliptical horn transition section introduces part of the phase differential needed at both the high and low bands.

For antenna feed horn 970 described with reference to FIG. 9*f*, the elliptical transition section 971 introduces a nominal 130 degrees of low band phase differential and 70 degrees of high band phase differential. The IPDS introduces a nominal −40 degrees of low band opposite slop phase differential and −25 degrees of high band phase differential. So at the input to the diplexer 90 degrees (=130 degrees−40 degrees) of phase differential has been introduced at low band providing excellent low band CP to LP conversion performance so that the diplexer can extract the resulting low band linear polarity signals into the side ports and pass the high band signals that only have 45 degrees (=70 degrees−25 degrees) of phase differential. The SPDS then introduces a nominal −135 degrees of opposite slope high band phase differential needed so that the total high band phase differential of −90 degrees (=70 degrees−25 degrees−135 degrees) results and good CP to LP conversion occurs at high band as well For antenna feed horn 980 described with reference to FIG. 9*g*, the elliptical transition section 982 introduces a nominal 90 degrees of low band phase differential and 50 degrees of high band phase differential. There is no need for an IPDS in this case because the elliptical horn introduced the entire nominal 90 degrees of low band phase differential providing good low band CP to LP conversion performance so that the diplexer can extract the resulting low band linear polarity signals into the side ports and pass the high band signals that only have 50 degrees of phase differential. The SPDS then introduces a nominal −160 degrees of opposite slope high band phase differential needed so that the total high band phase differential of −90 degrees (=50 degrees−160 degrees) results and good CP to LP conversion occurs at high band as well.

For the antenna feed horn 990 described with reference to FIG. 9*g* the elliptical transition section 981 introduces a nominal 60 degrees of low band phase differential and 35 degrees of high band phase differential. The IPDS introduces a nominal 30 degrees of low band additive phase differential and 20 degrees of high band phase differential. So at the input to the diplexer 90 degrees (=60 degrees+30 degrees) of phase differential has been introduced at low band providing good low band CP to LP conversion performance so that the diplexer can extract the resulting low band linear polarity signals into the side ports and pass the high band signals that only have 55 degrees (=35 degrees+20 degrees) of phase differential. The SPDS then introduces an nominal −145 degrees of opposite slope high band phase differential needed so that the total high band phase differential of −90 degrees (=35 degrees+20 degrees−145 degrees) results and good CP to LP conversion occurs at high band as well.

It should again be noted that the phase IPDS and SPDS can be designed such that the resulting nominal phase differentials for the low band and the high band are integer multiples of 90 deg. It is also easy to see how the same principles could continue on and on for improving performance not only across 2 bands but multiple frequency bands, by simply adding more phase compensation sections between each successive section where different bands are split off. Furthermore, it is also easy to see how any of these bands could be linear polarity by simply aligning the pick up probes, slots etc. with the polarizer and/or phase compensation section.

The antenna feed horn 1100 described with reference to FIGS. 11A-B is an elliptical (or oblong) beam horn with phase compensation section for use with conventional CP Polarizers. To enable this embodiment, the inventor recognizes that a phase compensation section can be designed and placed between the elliptical horn and CP polarizer such that a conventional CP polarizer oriented in the more traditional 45 degrees plane as shown in FIGS. 11A-B can be used. This is convenient for mechanical packaging purposes for some applications because the pick up probes and or slots (in OMTs and/or diplexing components) can be oriented vertically or horizontally.

The phase compensation section 1104 introduces a phase differential (30 degrees for example) between the 2 orthogonal components (H and V in this example) that is equal and opposite to the phase differential already introduced by the elliptical horn (30 deg). So the total phase differential introduced by the horn and phase compensation section is zero degrees=(30−30 deg). In theory this re-establishes perfect CP between the phase compensation section and CP polarizer, so a conventional CP polarizer oriented at 45 degrees can be used and results in vertically or horizontally oriented linear polarity pick up probes slots, etc which is convenient for some LNBs, LNBF, OMTs and other waveguide or other feed assemblies etc. In fact the conventional CP can be oriented at any angle in order to orient the pick probes/slots at any number of orientations.

This antenna feed horn 1100 works best if the phase compensation section is aligned vertically as shown in FIG. 11A. However the principles of the invention are also applicable to any alternative embodiment constructed by orienting the phase compensation section at other angles. The principles of the invention are also applicable to any alternative embodiment constructed by breaking up the phase compensation section/function further into multiple sections or to brake up the CP polarizer into multiple sections/functions.

For antenna feed horn 1100, the total length of the horn, phase compensation section and conventional polarizer will in general be slightly longer and more difficult to make than the antenna feed horn 400 (FIGS. 4A-B) and significantly longer and moderately more difficult to make than the antenna feed horn 600 (FIGS. 6A-B). However the phase compensation section of this third embodiment could be easily and cost effectively integrated into the horn casting.

Referring now to FIGS. 10A-B and 12A-C, all of these embodiments can be used in single-feed or multi-feed reflector systems where the feeds are mounted separately or integrated in one or more housings that are mounted on an antenna dish to generate multiple receive and/or transmit beams for receiving from or transmitting to multiple nominal sources and/or receiver locations such as multiple satellite locations that can be separated by as little one degrees and as much as 180 degrees. FIGS. 3A-D illustrate a system that has three of these feeds integrated into a LNBF housing (triple LNBF Low Noise Block Down Converter with integrated Feeds) near the center of the reflector as well as two other more conventional feeds integrated into another LNBF housing (dual LNBF) that is significantly displaced from the reflector center. The horns of the triple LNBF are relatively tightly spaced to provide reflector beams to receive signals from three satellites that are spaced about 1.8 degrees apart. The dual LNBF feeds are spaced much further apart for receiving satellites spaced about nine degrees apart.

More specifically, for the centrally located triple-horn block, the LNBF the outer two feeds are for the Ka Satellite Band (downlink frequencies of 18.3-18.8 and 19.7-20.2 GHz) at nominal satellite locations of 99.2 and 102.8 west longitude. The center feed is for the Ku BSS (Broadcast Satellite Service) Band (downlink frequencies of 12.2-12.7 GHz) at a nominal satellite location of 101 degrees West longitude.

For the dual LNBF attached with the out rigger antenna feed block, the two feeds are for the Ku BSS (Broadcast Satellite Service) Band (downlink frequencies of 12.2-12.7 GHz) at a nominal satellite location of 110 and 119 degrees West longitude.

FIG. 12 A-C illustrate a system that has one of these feeds (attached to an LNB and covered in a shroud) mounted near the center of the reflector as well as two other conventional circular feed LNBFs (low noise block down converters with integrated feed horns) that are significantly displaced from the reflector center. The center feed is designed to receive circular polarity from two satellites that are very close together. One satellite is for the Ku BSS band and is nominally located at 119 degrees west longitude, and the other is for Ku FSS band is nominally located at 118.7 degrees west longitude. The center feed is an elliptical beam circular polarity broadband feed as described with reference to the antenna feed horn 600 illustrated in FIGS. 6A-B. This enhances the performance of the elliptical reflector system by improving gain, noise temperature, adjacent satellite rejection and cross polarity isolation over the required broad frequency range. The outer feeds are displaced with outrigger brackets to receive Ku BSS band services from 110 degrees west longitude and 128 degrees west longitude.

All of these feeds support both right hand circular polarity and left hand circular polarity simultaneously. Of course, this a specific illustrative geometry and, as discussed previously, the invention can be used for many combinations of frequencies, polarities and satellite locations.

For single polarity applications, it is worth noting that the transition section could simply transition from an elliptical radiating aperture to a rectangular or other oblong waveguide (including ridged waveguide) instead of circular or square waveguide. The rectangular waveguide would typically be oriented at 45 degrees relative to the major or minor axis of the elliptical radiating aperture.

The inventor further recognized that all embodiments discussed above could also include additional metal or plastic ridges, slabs, posts or other structures protruding out of or placed against the major axis walls and/or the minor axis walls such that they protrude into the throat of the horn transition section. This is done to better control the physical lengths for general product size requirements/constraints and/or for ease of integration into single die cast parts of multi-feed LNBF assemblies and possibly. This could also be employed to better control the specific amount and slope of the phase differential versus frequency of the transition section. As an example, the center feed in FIGS. 10A-B illustrates an embodiment with a square antenna feed horn with, in this example, ridges in the top and bottom walls. Adding the ridges in these wall forces the horn transition section (from oblong to square waveguide) to become longer in order to provide the desired amount of phase differential (somewhat greater than 90 degrees in this case) which, in turn, causes the oppositely slope phase differential section to lengthen as well, so that the resulting total phase differential is 90 degrees. It was necessary to make this center feed longer in order to match the length of the outer feeds so that they could be easily die-cast as a single unit. If ridges are placed in the two side walls, or in all four walls, instead of only in the top and bottom walls, then the feed can be shorter.

Therefore, it will be understood that various embodiments of the invention have the features and exhibit the advantages described below.

1. An elliptical (or other oblong) beam circular polarity receiving and/or transmitting device comprising either detachable or integrated electronics (such as low noise block down converters, amplifiers, transmitters, or transceivers), any necessary waveguide interface components and a simple horn that transitions abruptly and/or smoothly in one or more sections from a circular, or square waveguide to an elliptical, rectangular or other elongated radiating aperture where the aperture size (height and width), circular waveguide size, and transition section dimensions (lengths, heights, widths, flare angles and step sizes) are chosen to achieve good circular polarity performance (match and cross polarization isolation), and the desired radiation pattern characteristics without using cumbersome metal or dielectric septums or structures stretching across the inside of the horn for phase compensation. These dimensions are chosen to achieve a phase differential between orthogonal linear modes that are lined up with the wide (major) and narrow (minor) axis of the oblong horn. The phase differential is typically designed to be either +90 degrees or −90 degrees at a nominally frequency and varies across the frequency band to some degree, but can be any odd integer multiple of 90 degrees, such as −630 degrees, −450 degrees, −270 degrees, −90 degrees, 90 degrees, 270 degrees, 450 degrees, 630 degrees and so forth.
2. An elliptical (or other oblong) circular polarity receiving and/or transmitting device comprising of either detachable or integrated electronics (low noise block down converters, amplifiers, transmitters, or transceivers), any necessary waveguide interface components, a simple horn that transitions abruptly and/or smoothly in one or more sections from a circular, or square waveguide to an elliptical, rectangular or other elongated radiating aperture, and an opposite slope phase differential section.
3. An elliptical (or other oblong) beam circular polarity receiving and/or transmitting device comprising of either detachable or integrated electronics (low noise block down converters, amplifiers, transmitters, or transceivers), any necessary waveguide interface components, a simple horn that transitions abruptly and/or smoothly in one or more sections from a circular, or square waveguide to an elliptical, rectangular or other elongated radiating aperture, and an additive phase differential section.
4. An elliptical (or other oblong) beam circular polarity receiving and/or transmitting device of that includes additional metal or plastic ridges, slabs, posts or other structures protruding out of or placed against the side walls of major axis and/or the side walls of the minor axis such that they protrude into the throat of the horn transition section for the purpose of
   a) better controlling the physical lengths for general product size requirements/constraints and/or for ease of integration into single die cast parts of multi-feed LNBF assemblies, and
   b) and better controlling the specific amount and slope of the phase differential versus frequency of the transition section.

5. The elliptical (or other oblong) beam circular polarity receiving and/or transmitting device mounted on an antenna dish to generate a receive beam and/or transmit beam for receiving from or transmitting to a nominal source and/or receiver location such as a nominal geostationary satellite location that has several satellites at that location, where in one or more frequency bands and/or one or more polarities can be received from and/or transmitted to the location.
6. Multiple elliptical (or other oblong) beam circular polarity receiving and/or transmitting devices mounted separately or integrated in one or more housings that are mounted on an antenna dish to generate multiple receive and/or transmit beams for receiving from or transmitting to multiple nominal sources and/or receiver locations such as multiple satellite locations, where in the locations can be separated by as little 1 degrees and as much as 180 degrees and where in one or more frequency bands and/or one or more polarities can be received from and/or transmitted to each location.
7. One or more elliptical (or other oblong) beam circular polarity receiving and/or transmitting devices of the type described in advantages 1 and/or 2 and/or 3 and/or 4, as described above, with one or more circular and/or linear polarity circular aperture receiving devices and/or one or more linear polarity elliptical (or other oblong) linear polarity devices mounted on an antenna dish to generate multiple receive and/or transmit beams for receiving from or transmitting to multiple nominal source and/or receiver locations such as multiple satellite locations, where in the locations can be separated by as little 1 degrees and as much as 180 degrees.

The invention claimed is:

1. An antenna feed horn extending in a signal propagation direction, comprising:

a reception end defined by an undivided, oblong input aperture;

an output aperture spaced apart from the input aperture in the signal propagation direction;

a phase adjustment structure extending from the input aperture to the output aperture comprising an interior surface defining an oblong, undivided cross-section perpendicular to the signal propagation direction over a substantial portion of the phase adjustment structure in the signal propagation direction; and for a signal propagating at a desired frequency and exhibiting circular polarity expressed by orthogonal linear components when incident at the input aperture, the interior surface of the phase adjustment structure configured to differentially phase shift the linear components by approximately 90 degrees to convert the signal from circular polarity to linearly polarity as the signal propagates through the phase adjustment structure.

2. The antenna feed horn of claim 1, wherein the phase adjustment structure comprises a transition section that differentially phase shifts the linear components in a first direction by an initial amount less than 90 degrees and an additive phase differential section that differentially phase shifts the linear components by an additive amount in the first direction to impart a total differential phase shift through the phase adjustment structure of approximately 90 degrees.

3. The antenna feed horn of claim 1, wherein the phase adjustment structure comprises a transition section that differentially phase shifts the linear components in a first direction by an initial amount greater than 90 degrees and an oppositely sloped phase differential section that differentially phase shifts the linear components by a subtractive amount in a second direction opposing the first direction to impart a total differential phase shift through the phase adjustment structure of approximately 90 degrees.

4. The antenna feed horn of claim 3, wherein:

the transition section exhibits a phase differential versus frequency transfer function that slopes in a first direction across an operational frequency band of the antenna feed horn; and the oppositely sloped phase differential section exhibits a phase differential versus frequency transfer function that slopes in a direction opposing the first direction across the operational frequency band of the antenna feed horn.

5. The antenna feed horn of claim 4, wherein, for an operational frequency band between a low-end frequency of 18.3 GHz and a high-end frequency 20.2 GHz, the differential phase shift through the antenna feed horn differs from 90 degrees by no more than ten degrees over the operational frequency band.

6. The antenna feed horn of claim 4, wherein, for an operational frequency band between a low-end frequency of 11.7 GHz and a high-end frequency 12.7 GHz, the differential phase shift through the antenna feed horn differs from 90 degrees by no more than ten degrees over the operational frequency band.

7. The antenna feed horn of claim 1, wherein the oblong, undivided cross-section of the interior surface of the phase adjustment structure is substantially elliptical or substantially rectangular.

8. The antenna feed horn of claim 1, wherein the interior surface of the phase adjustment structure is smooth-walled, comprises one or more ridges extending in the signal propagation direction, or comprises a smooth-walled first portion and a second portion comprising one or more ridges extending in the propagation direction.

9. The antenna feed horn of claim 1, further comprising two additional antenna feed horns as described in claim 1 disposed within a common integral housing, and wherein each antenna feed horn is positioned to receive signals from an associated satellite, and the satellites are located approximately within a four degree longitudinal zone.

10. An antenna feed horn extending in a signal propagation direction and, for a signal propagating through the antenna feed horn at a desired frequency and exhibiting a polarity expressed by linear components, the phase adjustment structure comprising:

a transition section that differentially phase shifts the linear components in a first direction; and an oppositely sloped phase differential section that differentially phase shifts the linear components by a subtractive amount in a second direction opposing the first direction.

11. The antenna feed horn of claim 10, wherein:

the transition section exhibits a phase differential versus frequency transfer function that slopes in a first direction across an operational frequency band of the antenna feed horn;

the oppositely sloped phase differential section exhibits a phase differential versus frequency transfer function that slopes in a second direction opposing the first direction across the operational frequency band of the antenna feed horn.

12. The antenna feed horn of claim 11, wherein, for an operational frequency band between a low-end frequency of 18.3 GHz and a high-end frequency 20.2 GHz, the differential phase shift through the antenna feed horn differs from 90 degrees by no more than ten degrees over the operational frequency band.

13. The antenna feed horn of claim 11, wherein, for an operational frequency band between a low-end frequency of 11.7 GHz and a high-end frequency 12.7 GHz, the differential phase shift through the antenna feed horn differs from 90 degrees by no more than ten degrees over the operational frequency band.

14. An antenna feed horn comprising a phase adjustment structure extending in a signal propagation direction, the phase adjustment structure comprising:

a non-corrugated interior surface extending in the signal propagation direction and defining an oblong, undivided cross-section perpendicular to the signal propagation direction over a substantial portion of the phase adjustment structure in the signal propagation direction; and for a signal propagating at a desired frequency and exhibiting circular polarity expressed by orthogonal linear components when incident at the input aperture, the interior surface of the phase adjustment structure configured to deliver the signal to the output aperture exhibiting circular polarity.

15. The antenna feed horn of claim 14, wherein the interior surface of the phase adjustment structure is smooth-walled, comprises one or more ridges extending in the signal propagation direction, or comprises a smooth-walled first portion and a second portion comprising one or more ridges extending in the propagation direction.

16. An antenna comprising an oblong reflector and an antenna feed horn positioned and configured to illuminate substantially all of the oblong reflector, the antenna feed horn comprising:

a reception end defined by an undivided, oblong input aperture;

an output aperture spaced apart from the input aperture in the signal propagation direction;

a phase adjustment structure extending from the input aperture to the output aperture comprising a interior surface defining an oblong, undivided cross-section perpendicular to the signal propagation direction over a substantial portion of the phase adjustment structure in the signal propagation direction; and for a signal propagating at a desired frequency and exhibiting circular polarity expressed by orthogonal linear components when incident at the input aperture, the interior surface of the phase adjustment structure configured to differentially phase shift the linear components by approximately 90 degrees to convert the signal from circular polarity to linearly polarity as the signal propagates through the phase adjustment structure.

17. The antenna of claim 16, further comprising two additional antenna feed horns as described in claim 16 disposed within a common integral housing, and wherein:

each feed horn is positioned to receive signals from an associated satellite; and the satellites are located approximately within a four degree longitudinal zone.

18. The antenna of claim 17, wherein, for each antenna feed horn, the phase adjustment structure of comprises a transition section that differentially phase shifts the linear components in a first direction by an initial amount greater than 90 degrees and an oppositely sloped phase differential section that differentially phase shifts the linear components by a subtractive amount in a second direction opposing the first direction to impart a total differential phase shift through the phase adjustment structure of approximately 90 degrees.

19. The antenna of claim 18, wherein, for each antenna feed horn:

the transition section exhibits a phase differential versus frequency transfer function that slopes in a first direction across an operational frequency band of the antenna feed horn; and the oppositely sloped phase differential section exhibits a phase differential versus frequency transfer function that slopes in a direction opposing the first direction across the operational frequency band of the antenna feed horn.

* * * * *

UNITED STATES PATENT AND TRADEMARK OFFICE

CERTIFICATE OF CORRECTION

PATENT NO. : 7,239,285 B2
APPLICATION NO. : 11/132763
DATED : July 3, 2007
INVENTOR(S) : Scott J. Cook It is certified that error appears in the above-identified patent and that said Letters Patent is hereby corrected as shown below:

On Title Page Item 73 please remove "ProBrand International, Inc." as the Assignee.

Signed and Sealed this

Sixteenth Day of October, 2007

JON W. DUDAS
*Director of the United States Patent and Trademark Office*